US010506901B2

(12) United States Patent
Schuh et al.

(10) Patent No.: US 10,506,901 B2
(45) Date of Patent: Dec. 17, 2019

(54) SHEET PRODUCT DISPENSER WITH PRODUCT LEVEL INDICATOR CALIBRATION

(71) Applicant: GPCP IP HOLDINGS LLC, Atlanta, GA (US)

(72) Inventors: Ryan Joseph Schuh, Kimberly, WI (US); David Warren Murphy, Neenah, WI (US)

(73) Assignee: GPCP IP HOLDINGS LLC, Atlanta, GA (US)

( * ) Notice: Subject to any disclaimer, the term of this patent is extended or adjusted under 35 U.S.C. 154(b) by 0 days.

(21) Appl. No.: 16/015,535

(22) Filed: Jun. 22, 2018

(65) Prior Publication Data

US 2018/0368628 A1 Dec. 27, 2018

Related U.S. Application Data

(60) Provisional application No. 62/524,146, filed on Jun. 23, 2017.

(51) Int. Cl.

| | |
|---|---|
| ***A47K 10/36*** | (2006.01) |
| ***A47K 10/38*** | (2006.01) |
| *A47K 10/32* | (2006.01) |

(52) U.S. Cl.

CPC ..... *A47K 10/3687* (2013.01); *A47K 10/3612* (2013.01); *A47K 10/38* (2013.01); (Continued)

(58) Field of Classification Search

CPC ..... B65F 2210/168; B65F 2210/144; B65F 2210/1443; A47K 10/24; A47K 10/424

See application file for complete search history.

(56) References Cited

U.S. PATENT DOCUMENTS

| | | | |
|---|---|---|---|
| 2,601,956 | A | 7/1952 | Birr |
| 3,288,387 | A | 11/1966 | Craven, Jr. |

(Continued)

FOREIGN PATENT DOCUMENTS

| | | |
|---|---|---|
| GB | 1 296 335 A | 11/1972 |
| SE | 364178 | 2/1974 |

(Continued)

OTHER PUBLICATIONS

Georgia-Pacific—Catalog Home—Paper Towels & Dispensers—GP enMotion® Splash Blue Impulse® 8 Automated Towel Dispenser Description; website visited Aug. 22, 2016; 2pgs. http://catalog.gppro.com/catalog/6357/11795?filter_FULL.

(Continued)

*Primary Examiner* — Jacob S. Scott
*Assistant Examiner* — Ayodeji T Ojofeitimi
(74) *Attorney, Agent, or Firm* — Nelson Mullins Riley & Scarborough LLP

(57) ABSTRACT

A sheet product dispenser is provided including a housing including a roll holder configured to receive a product roll, a dispensing mechanism configured to dispense a portion of the sheet product from the product roll, a sensor configured to emit a signal toward the product roll and receive a reflection of the signal from a surface of the product roll, and a controller. The controller is configured to receive an indication of replacement of the product roll, determine a time-of-flight of the signal, and determine an expected time-of-flight (or corresponding distance of travel) of a theoretical signal to a theoretical full product roll. The controller is further configured to compare the time-of-flight (or a corresponding distance of travel) of the signal to the product roll to the expected time-of-flight or distance, and adjust a product depletion curve based on the comparison.

20 Claims, 11 Drawing Sheets

(52) U.S. Cl.
CPC ..... *A47K 10/3637* (2013.01); *A47K 10/3643* (2013.01); *A47K 2010/3226* (2013.01); *A47K 2010/3253* (2013.01); *A47K 2010/3681* (2013.01); *A47K 2010/3693* (2013.01)

(56) References Cited

U.S. PATENT DOCUMENTS

| | | | | |
|---|---|---|---|---|
| 5,244,161 | A | 9/1993 | Wirtz-Odenthal | |
| 5,294,192 | A | 3/1994 | Omdoll et al. | |
| 5,441,189 | A | 8/1995 | Formon et al. | |
| 5,772,291 | A | 6/1998 | Byrd et al. | |
| 6,354,533 | B1 | 3/2002 | Jespersen | |
| 6,360,181 | B1 | 3/2002 | Gemmell et al. | |
| 6,411,920 | B1 | 6/2002 | McConnell et al. | |
| 6,685,074 | B2 | 2/2004 | Gracyalny et al. | |
| 6,766,977 | B2 | 7/2004 | Denen et al. | |
| 6,826,991 | B1 | 12/2004 | Rasmussen | |
| 6,830,210 | B2 | 12/2004 | Formon et al. | |
| 6,908,059 | B2 | 6/2005 | Budz et al. | |
| 7,040,566 | B1 | 5/2006 | Rodrian et al. | |
| 7,270,292 | B2 | 9/2007 | Rasmussen | |
| 7,370,824 | B1 | 5/2008 | Osborne | |
| 7,507,045 | B1 | 3/2009 | Harris et al. | |
| 7,523,885 | B2 | 4/2009 | Lewis | |
| 7,648,098 | B2 | 1/2010 | Goeking et al. | |
| 7,726,599 | B2 | 6/2010 | Lewis et al. | |
| 7,774,096 | B2 | 8/2010 | Goerg et al. | |
| 7,783,380 | B2 | 8/2010 | York et al. | |
| 7,793,882 | B2 | 9/2010 | Reinsel et al. | |
| 7,814,582 | B2 | 10/2010 | Reddy et al. | |
| 7,984,872 | B2 | 7/2011 | Kuehneman et al. | |
| 7,996,108 | B2 | 8/2011 | Yardley | |
| 8,160,742 | B2 | 4/2012 | Goerg et al. | |
| 8,511,599 | B2 | 8/2013 | Lalau et al. | |
| 8,600,547 | B2 | 12/2013 | Petersen et al. | |
| 8,616,489 | B2 | 12/2013 | Goeking et al. | |
| 8,800,415 | B2 | 8/2014 | Osborne | |
| 8,807,475 | B2 | 9/2014 | Rodrian et al. | |
| 9,067,754 | B2 | 6/2015 | Petersen et al. | |
| 10,278,550 | B2 | 5/2019 | Ophardt et al. | |
| 2004/0134924 | A1* | 7/2004 | Hansen | A47K 10/36 221/9 |
| 2006/0173576 | A1* | 8/2006 | Goerg | A47K 10/3845 700/236 |
| 2007/0194166 | A1 | 8/2007 | Reinsel et al. | |
| 2007/0236110 | A1* | 10/2007 | Kling | A47K 10/36 312/34.4 |
| 2008/0099595 | A1 | 5/2008 | Lewis | |
| 2008/0190982 | A1* | 8/2008 | Omdoll | A47K 10/3656 225/14 |
| 2008/0245922 | A1 | 10/2008 | Fellhoelter | |
| 2009/0250484 | A1* | 10/2009 | Kling | B65H 26/00 221/14 |
| 2010/0163571 | A1* | 7/2010 | Mizoro | B65H 29/006 221/71 |
| 2012/0061415 | A1* | 3/2012 | Hagleitner | A47K 5/1217 221/1 |
| 2013/0079923 | A1 | 3/2013 | Cittadino et al. | |
| 2013/0161346 | A1* | 6/2013 | Wolme | A47K 10/38 221/26 |
| 2013/0240554 | A1 | 9/2013 | Stråhlin et al. | |
| 2014/0067113 | A1 | 3/2014 | Petersen et al. | |
| 2014/0367401 | A1* | 12/2014 | Stralin | A47K 10/22 221/6 |
| 2015/0066207 | A1 | 3/2015 | Erb | |
| 2015/0097068 | A1 | 4/2015 | Larson et al. | |
| 2015/0238056 | A1 | 8/2015 | Fellhoelter | |
| 2015/0313420 | A1 | 11/2015 | Tramontina et al. | |
| 2015/0327735 | A1* | 11/2015 | Himmelmann | A47K 10/3836 221/34 |
| 2016/0187484 | A1 | 6/2016 | Bloomfield et al. | |
| 2017/0042390 | A1 | 2/2017 | Rubenson et al. | |
| 2017/0051481 | A1 | 2/2017 | Mercer | |
| 2017/0057775 | A1 | 3/2017 | Kobs et al. | |
| 2017/0290471 | A1 | 10/2017 | Borke et al. | |
| 2017/0369262 | A1* | 12/2017 | Green | B65H 26/066 |
| 2018/0008104 | A1* | 1/2018 | Becker | B65H 26/06 |
| 2018/0333013 | A1* | 11/2018 | Starkey | A47K 10/36 |
| 2018/0368626 | A1* | 12/2018 | Williams, Jr. | A47K 10/24 |

FOREIGN PATENT DOCUMENTS

| | | | |
|---|---|---|---|
| WO | WO 2005/065509 | A1 | 7/2005 |
| WO | WO 2007/068884 | | 6/2007 |
| WO | WO 2017/105464 | A1 | 12/2015 |
| WO | WO 2019/057270 | A1 | 3/2019 |

OTHER PUBLICATIONS

Georgia-Pacific—Catalog Home—Paper Towels & Dispensers—GP enMotion® Splash Blue Impulse® 10 Automated Towel Dispenser Description; website visited Aug. 22, 2016; 2pgs. http://catalog.gppro.com/catalog/6387/12519?filter_FULL.

YouTube Video—Georgia-Pacific enMotion® Impulse 10 Automated Towel Dispenser Support; website visited Aug. 22, 2016; 1 pg. https://www.youtube.com/watch?v=8Cyypt-xGs0&list-PLF88677BE73FE88B5&index=1.

International Search Report and Written Opinion for PCT/US2016/048826, dated Nov. 4, 2016.

* cited by examiner

Full Product Roll Calibration Routine

Calibration Adjustment Limitation

Depleted Roll Calibration Routine

Normal Operating Routine

SHEET PRODUCT DISPENSER WITH PRODUCT LEVEL INDICATOR CALIBRATION

CROSS REFERENCE TO RELATED APPLICATION

This application claims priority to U.S. provisional Patent Application No. 62/524,146, filed Jun. 23, 2017, entitled "Sheet Product Dispenser with Product Level Indicator", which is hereby incorporated by reference in its entirety.

FIELD OF THE INVENTION

Example embodiments of the present invention generally relate to dispensers and, more particularly to, sheet product dispensers.

BACKGROUND

Sheet product dispensers, such as paper towel dispensers or tissue dispensers, provide on-demand sheet product to a user from a supply of sheet product stored within the dispenser, such as in roll form. The sheet product may be dispensed from the roll by passing one end of the sheet product through a pair of rollers. Depending on the type of dispenser, dispensing may be accomplished automatically (e.g., with a motor) or manually (e.g., using the force a user applies). As the user pulls the sheet product, cutting arrangements (or perforations) may be used to separate a portion for use (e.g., a dispensed portion).

Some dispensers have a single roll of sheet product usable for dispensing. Others have multiple rolls, one or more being stored for later use, such as once the first roll is depleted.

BRIEF SUMMARY

Some sheet product dispensers may include a product level indicator, which may indicate information about the remaining sheet product on a product roll. Depending on the configuration of the sheet product dispenser, various types of product level sensors can be used to determine the remaining product level within the dispenser. For example, mechanical-based product level sensors can interact directly or indirectly with the sheet product to determine the amount of product remaining. In other embodiments, product level sensors may indirectly interact with the sheet product, such as through optical or infrared detection. For example, a sheet product dispenser may utilize a light emitting product level sensor that is directed at the sheet product and configured to receive a reflected light signal. Such a sensor may be configured to measure the amount of light reflected by the product roll to determine the distance the light signal traveled, which measures the amount of sheet product remaining within the dispenser. However, measurement of the amount of light reflected back to the sensor may be dependent on the color of the sheet product. For example, white or light colored sheet product may be substantially more reflective than brown or dark sheet product. Some such product level sensors may need to know which color sheet product is being used to account for the change in reflection value of the signal in order to accurately determine the amount of sheet product remaining in the dispenser.

Some example embodiments of the present invention seek to provide a product level sensor that can determine the amount of product remaining independently of the color of the sheet product. In this regard, some example embodiments utilize a time-of-flight sensor, such as an infrared or ultrasonic sensor, to determine a remaining product level of one or more product rolls in a sheet product dispenser. Since the time-of-flight sensor is measuring the time a signal takes to be reflected back to the sensor (and not the amount of light reflected), the time-of-flight sensors may enable determination of the amount of sheet product remaining in the dispenser independent of the color of the sheet product.

To explain, in some embodiments, the product level sensor is configured to receive a reflected signal and determine its time-of-flight. Knowing the time of the flight of the received signal and the dimensions of the dispenser housing enables determination of a measured distance to the product roll. This measured distance to the product roll correlates to the amount of sheet product remaining on the product roll. The measured distance and/or measured time-of-flight may be compared to a product depletion curve to determine the remaining amount of sheet product on the product roll.

In some embodiments, the determined remaining amount of sheet product may be indicated to a user, such as through one or more product level indicators (e.g., light emitting diodes (LEDs)) on the dispenser. In some example embodiments, the product level indicators may operate to indicate one or more product level thresholds to a user, such as a low product level, e.g., less than 30 percent, a product depleted level, e.g., less than 10 percent, or the like.

In some embodiments, the determined amount of product remaining may be stored in memory and/or transmitted to a remote server. In some embodiments, raw measurement data (such as the time-of-flight of the received signal) may be transmitted to a remote server, such as for determination of the amount of product remaining at the remote server.

In some example embodiments, the product depletion curve may be predetermined, e.g., preprogramed. However, manufacturing tolerances and other factors for each specific dispenser may lead to inconsistencies in the anticipated time-of-flight values of the received signal for a corresponding amount of product remaining. For example, variations in manufacturing tolerances of the product roll or variations in the dimensions of the product dispenser housing may cause a predetermined product depletion curve to be less accurate.

In this regard, some example embodiments of the present invention seek to provide an automatic calibration method for calibrating the product depletion curve for each dispenser such that more accurate product remaining estimations can be achieved. In some embodiments, the sheet product dispenser may be configured to adjust the product depletion curve in each operating environment.

In one such example, the sheet product dispenser may determine that calibration should occur, such as by noticing a triggering event. For example, the sheet product dispenser may receive an indication that the product roll has been replaced and compare the measured time-of-flight or distance to the new product roll to that of an expected time-of-flight or distance to a full product roll from the product depletion curve. In response to the measured and expected time-of-flights or distances differing, the sheet product dispenser may adjust the product depletion curve to more accurately reflect the correlation between the measured time-of-flight or distance and the amount of product remaining on the product roll.

Similarly, in some embodiments, the sheet product dispenser may also be configured to calibrate the product depletion curve based on a measured time-of-flight or distance to a depleted product roll. Such a calibration routine may be performed in response to determining that the product roll has been depleted. For example, upon determination of a replacement product roll being inserted, the previously stored measured time-of-flight or distance may be checked (e.g., which may correlate to a depleted product roll prior to replacement).

In some example embodiments, adjustments to the product depletion curve may be limited (such as through a predetermined adjustment increment) to prevent overcompensation (which may, in some cases, be indicative of a measurement error).

In an example embodiment, a sheet product dispenser comprising a housing including a base portion and a cover is provided. The cover is movable relative to the base portion to define an open position and a closed position. The sheet product dispenser includes at least one roll holder configured to receive a product roll, a dispensing mechanism configured to receive sheet product from the product roll and dispense a portion of the sheet product from the product roll, and a sensor configured to emit a signal toward the product roll and receive the signal. The signal is reflected off a surface of the product roll. The sheet product dispenser further includes a controller configured to receive an indication that the product roll was installed into the at least one roll holder, operate the sensor to emit and receive the signal, and determine a time-of-flight of the signal that correlates to the time period from when the signal was emitted by the sensor to when the signal was received by the sensor. The controller is further configured to determine an expected characteristic of a theoretical signal for a theoretical full product roll installed in the sheet product dispenser. The expected characteristic comprises at least one of an expected time-of-flight of the theoretical signal and an expected distance to the surface of the theoretical full product roll. The controller is further configured to compare a characteristic of the signal to the expected characteristic of the theoretical signal. The characteristic of the signal is at least one of the time-of-flight of the signal or a distance to the surface of the installed product roll. The distance is determined based on the time-of-flight of the signal. The controller is further configured to adjust a product depletion curve based on the comparison.

In some embodiments, the controller is further configured to operate the sensor to emit and receive a second signal subsequent to operation of the dispensing mechanism to dispense the portion of the sheet product from the product roll. The controller may also be configured to determine a time-of-flight associated with the second signal and determine a remaining product level based on the time-of-flight associated with the second signal and the adjusted product depletion curve. Additionally, in some embodiments, the controller is further configured to compare the remaining product level to one or more predetermined product thresholds and cause one or more dispenser indicators to provide an indication to a user in response to satisfying one or more of the predetermined product thresholds. Additionally or alternatively, in some embodiments, the controller is further configured to compare the remaining product level to one or more predetermined product thresholds and cause an alert in response to satisfying one or more of the predetermined product thresholds.

In some embodiments, the controller is further configured to determine if a difference between the characteristic of the signal and the expected characteristic of the theoretical signal satisfies a predetermined adjustment threshold. Additionally, the controller may be configured to adjust, in response to determining that the difference satisfies the predetermined adjustment threshold, the product depletion curve by a predetermined incremental adjustment value, wherein the predetermined incremental adjustment value is the same regardless of a degree of the difference between the characteristic of the signal and the expected characteristic of the theoretical signal.

In some embodiments, the controller is further configured to determine if a difference between the characteristic of the signal and the expected characteristic of the theoretical signal satisfies a predetermined adjustment threshold and continue, in response to determining that the difference fails to satisfy the predetermined adjustment threshold, operation of the sheet product dispenser without an adjustment to the product depletion curve.

In some embodiments, the controller is further configured to determine an average characteristic of the signal based on a predetermined number of measurements that each correspond to a different signal and determine a difference between the average characteristic of the signal and the expected characteristic of the theoretical signal. The adjustment of the product depletion curve is based on the difference between the average characteristic of the signal and the expected characteristic of the theoretical signal.

In some embodiments, the controller is further configured to determine if the difference between the characteristic of the signal and the expected characteristic of the theoretical signal exceeds a maximum adjustment threshold and limit the adjustment to the product depletion curve to the predetermined maximum adjustment threshold in response to the difference between the characteristic of the signal and the expected characteristic of the theoretical signal exceeding the predetermined maximum adjustment threshold.

In some embodiments, the controller is further configured to receive an indication that the product roll is depleted, operate the sensor to emit and receive a second signal, determine a time-of-flight associated with the second signal, and determine an expected characteristic of a theoretical second signal for a theoretical depleted product roll in the sheet product dispenser. The expected characteristic comprises at least one of an expected time-of-flight of the theoretical second signal and an expected distance to the surface of the theoretical depleted product roll.

The controller may be further configured to compare a characteristic of the second signal to the expected characteristic of the theoretical second signal. The characteristic of the second signal is at least one of the time-of-flight of the second signal or a distance to the surface of the depleted product roll. The distance is determined based on the time-of-flight of the second signal. The controller may be further configured to adjust the product depletion curve based on the comparison of the characteristic of the second signal to the expected characteristic of the theoretical second signal.

In some embodiments, the sheet product dispenser further comprises a second roll holder configured to receive a second product roll and a second sensor configured to emit a second signal toward the second product roll and receive the second signal. The second signal is reflected off a surface of the second product roll. In some embodiments, the product roll is a first product roll, and the sheet product dispenser further comprises a roll partition disposed between the first product roll and the second product roll. The sensor is a first sensor, and at least one of the first sensor and the second sensor is attached to the roll partition.

In some embodiments, the sensor is attached to the base portion.

In some embodiments, the sensor is attached to the cover.

In some embodiments, determining the time-of-flight of the signal enables determining an amount of product remaining on the product roll independent of a color of the sheet product of the product roll.

In some embodiments, the controller is further configured to limit adjustment of the product depletion curve to one direction for each adjustable value.

In another example embodiment, a method of calibrating a product depletion curve for a sheet product dispenser is provided. The method comprises receiving an indication that a product roll was installed in the sheet product dispenser, wherein the sheet product dispenser comprises a dispensing mechanism configured to receive sheet product from the product roll and dispense a portion of the sheet product from the product roll. The method further comprises operating a sensor to emit and receive a signal. The sensor is configured to emit the signal toward the product roll and receive the signal, and the signal is reflected off a surface of the product roll. The method further comprises determining a time-of-flight of the signal that correlates to the time period from when the signal was emitted by the sensor to when the signal was received by the sensor and determining an expected characteristic of a theoretical signal for a theoretical full product roll installed in the sheet product dispenser. The expected characteristic comprises at least one of an expected time-of-flight of the theoretical signal and an expected distance to the surface of the theoretical full product roll. The method further comprises comparing a characteristic of the signal to the expected characteristic of the theoretical signal. The characteristic of the signal is at least one of the time-of-flight of the signal or a distance to the surface of the installed product roll. The distance is determined based on the time-of-flight of the signal. The method further comprises adjusting the product depletion curve based on the comparison.

In some embodiments, the method further comprises operating the sensor to emit and receive a second signal subsequent to operation of the dispensing mechanism to dispense the portion of the sheet product from the product roll, determining a time-of-flight associated with the second signal, and determining a remaining product level based on the time-of-flight associated with the second signal and the adjusted product depletion curve.

In yet another example embodiment, a sheet product dispenser is provided. The sheet product dispenser comprises a housing configured to receive a product roll for dispensing from the sheet product dispenser. The product roll comprises a roll of sheet product and defines a cylindrical shape with a diameter and an outer surface. The sheet product dispenser further comprises a sensor positioned within the housing and configured to emit a signal toward the outer surface of the product roll and receive a reflection of the signal after the signal bounces off the outer surface of the product roll. The product roll is positioned within the housing such that, as sheet product is dispensed from the product roll, the diameter of the product roll decreases and the outer surface moves further away from the sensor. The sheet product dispenser further comprises a controller configured to operate the sensor to emit the signal and receive the reflection of the signal, determine a time-of-flight of the signal that correlates to the time period from when the signal was emitted by the sensor to when the reflection of the signal was received by the sensor, and compare at least one of the determined time-of-flight of the signal or a distance to the outer surface of the product roll determined using the determined time-of-flight to a corresponding predetermined time-of-flight or predetermined distance. The predetermined time-of-flight is associated with an expected predetermined time-of-flight for a theoretical product roll installed in the housing. The predetermined distance is associated with an expected distance from the sensor to a theoretical product roll installed in the housing. The controller is further configured to adjust a product depletion curve based on the comparison.

In some embodiments, the controller is further configured to operate the sensor to emit a second signal subsequent to dispensing of the sheet product from the product roll, determine a time-of-flight associated with the second signal, and determine a remaining product level based on the time-of-flight associated with the second signal and the adjusted product depletion curve.

In some embodiments, the controller is further configured to determine if a difference between the at least one of the determined time-of-flight of the signal or the distance to the outer surface of the product roll and the corresponding predetermined time-of-flight or predetermined distance satisfies a predetermined adjustment threshold. The controller may be further configured to adjust, in response to determining that the difference satisfies the predetermined adjustment threshold, the product depletion curve by a predetermined incremental adjustment value, wherein the predetermined incremental adjustment value is the same regardless of a degree of the difference.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Figure 1:
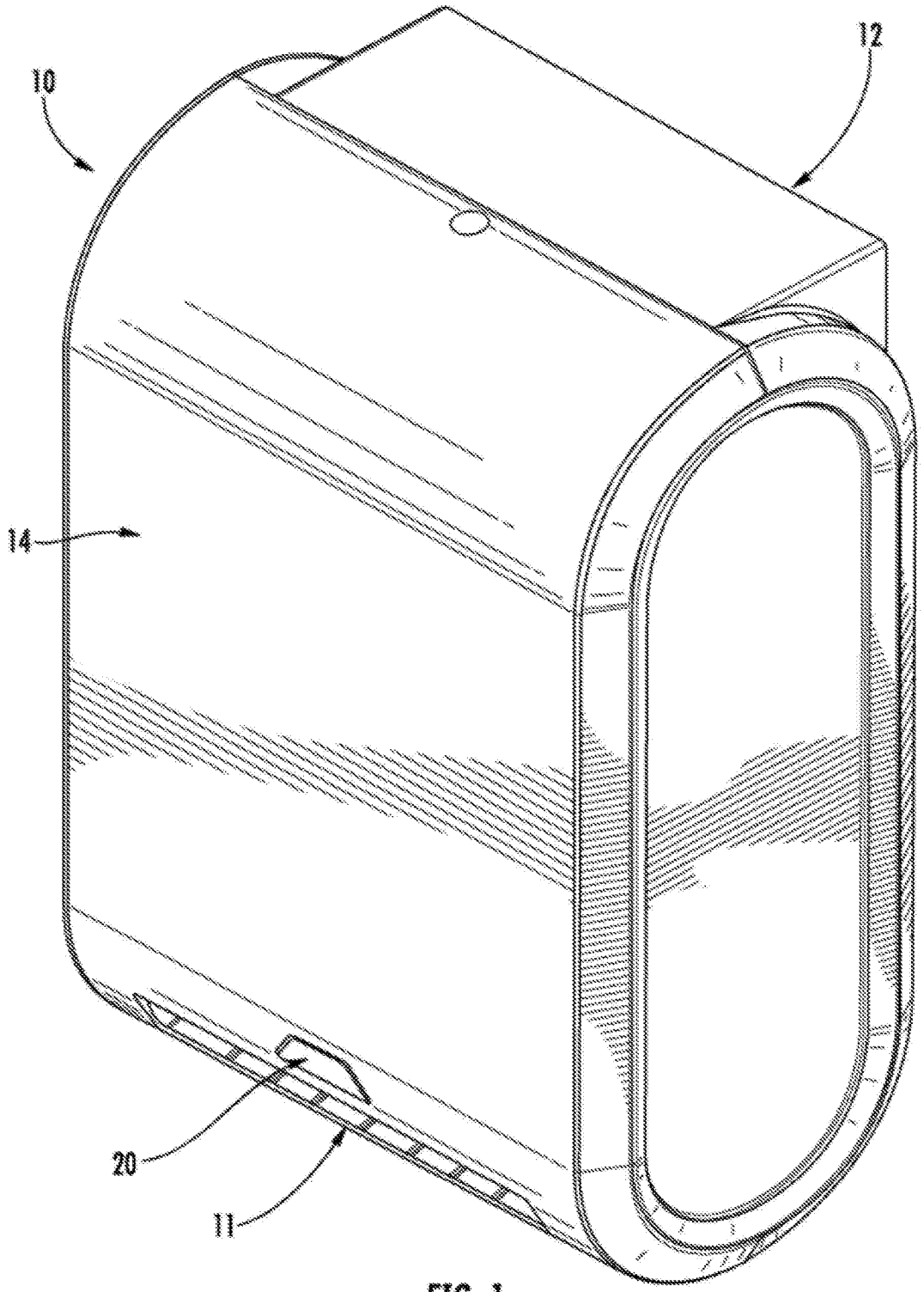
FIG. 1 shows a perspective view of an example sheet product dispenser, in accordance with some embodiments discussed herein.

Some example embodiments now will be described more fully hereinafter with reference to the accompanying drawings, in which some, but not all, example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout.

As used herein, a "user" of example product dispensers may be a maintainer (e.g., a maintenance person, a janitor, a facility manager, etc.) or a consumer (e.g., a person receiving a dispensed portion of the product).

Example Sheet Product Dispenser

Figure 2:
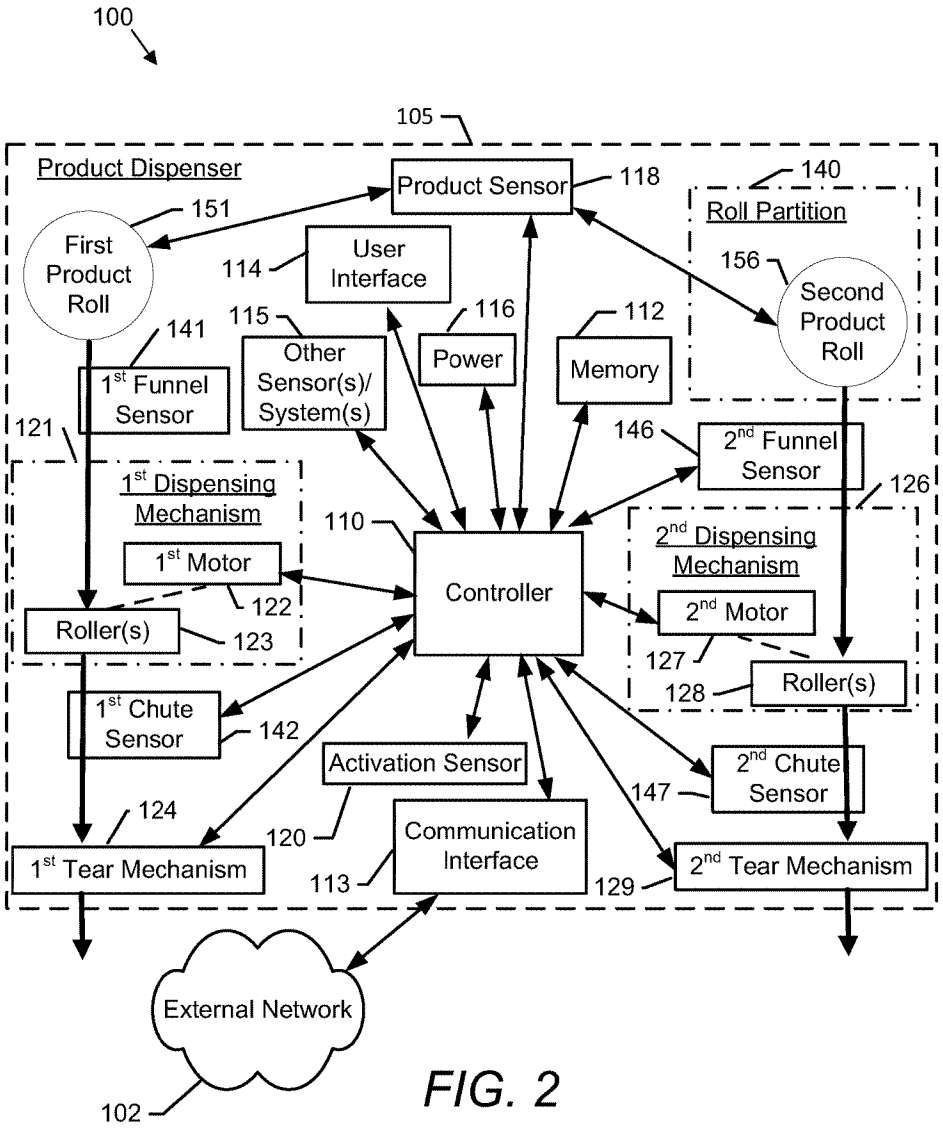
FIG. 2 shows a block diagram illustrating an example system for controlling and operating an example sheet product dispenser, in accordance with some embodiments discussed herein.

FIG. 1 illustrates an example sheet product dispenser 10 according to some embodiments of the present invention, such as in accordance with the sheet product dispenser 105 and its corresponding components described with respect to FIG. 2. The sheet product dispenser 10 includes a housing defined by a base portion 12 and a cover 14. The sheet product dispenser 10 includes at least one dispensing slot 11 where the sheet product (e.g., paper towel) is provided to the user. Such sheet product may, such as described herein, be dispensed in response to user input being provided to an activation sensor 20 (e.g., in the circumstance where the sheet product dispenser is automated).

As used herein, the term "sheet product" may include a product that is relatively thin in comparison to its length and width. Further, the sheet product may define a relatively flat, planar configuration. In some embodiments, the sheet product is flexible or bendable to permit, for example, folding, rolling, stacking, or the like. In this regard, sheet product may, in some cases, be formed into stacks or rolls for use with various embodiments described herein. Some example sheet products include towel, bath tissue, facial tissue, napkin, wipe, wrapping paper, aluminum foil, wax paper, plastic wrap, or other sheet-like products. Sheet products may be made from paper, cloth, non-woven, metallic, polymer or other materials, and in some cases may include multiple layers or plies. In some embodiments, the sheet product (such as in roll or stacked form) may be a continuous sheet that is severable or separable into individual sheets using, for example, a tear bar or cutting blade. Additionally or alternatively, the sheet product may include predefined areas of weakness, such as lines of perforations, that define individual sheets and facilitate separation and/or tearing. In some such embodiments, the lines of perforations may extend along the width of the sheet product to define individual sheets that can be torn off by a user.

Figure 3:
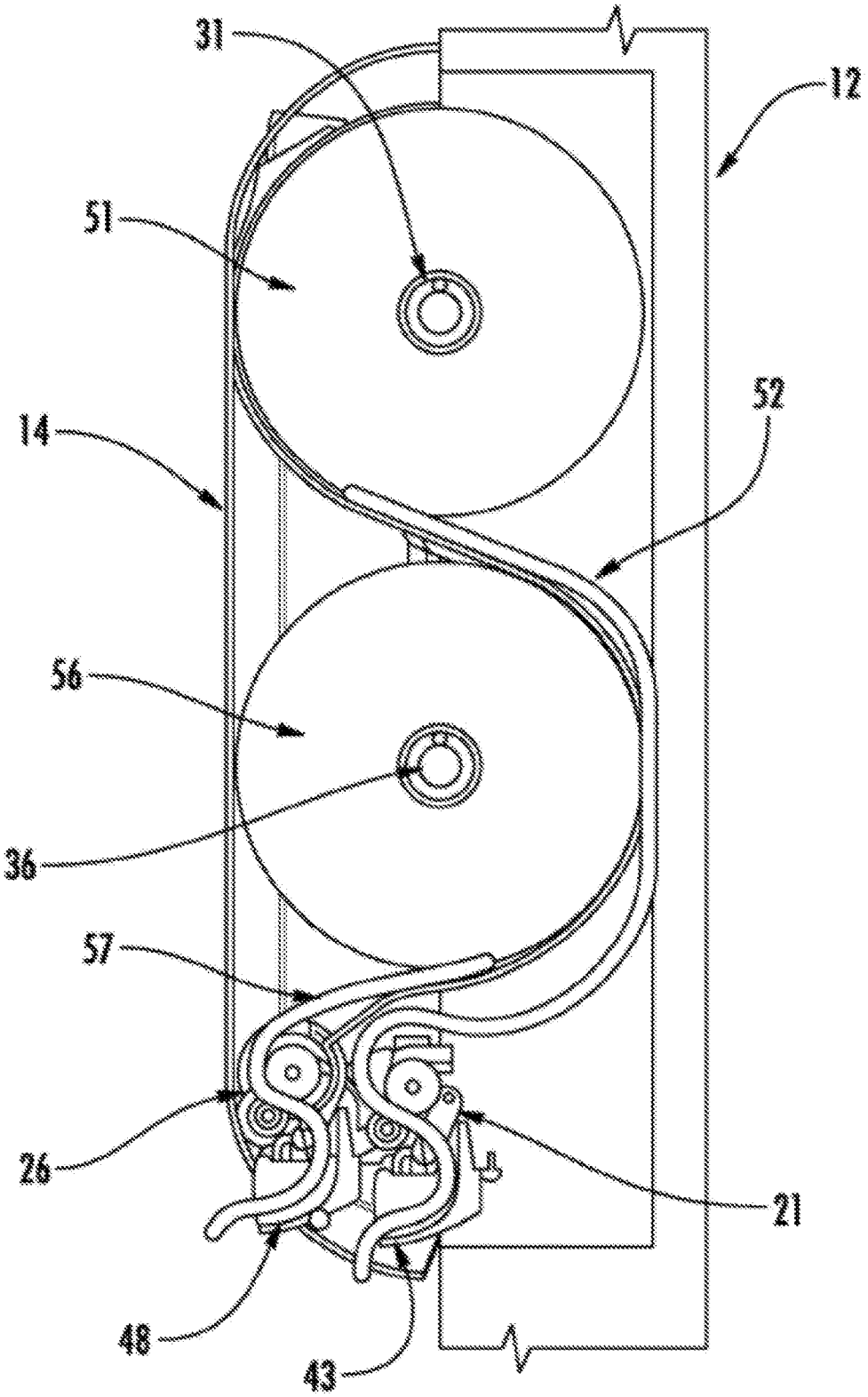
FIG. 3 illustrates a schematic cross-sectional view of components of an example sheet product dispenser, in accordance with some embodiments discussed herein.

In some embodiments, the sheet product dispenser 10 is sized to support two full sheet product rolls and two separate web paths, each one leading to separate dispensing mechanisms. For example, with reference to FIG. 3, the sheet product dispenser 10 comprises a first set of roll holders 31 to hold a first sheet product roll 51 (e.g., first product roll 151 of FIG. 2) near the top of the dispenser 10. A first web path 52 leads from the first sheet product roll 51 to a first dispensing mechanism 21 (e.g., first dispensing mechanism 121 of FIG. 2). Upon activation and after completing a dispense (using the first dispensing mechanism 21), a portion of the first sheet product roll 51 extends out of a first chute 43 below the first dispensing mechanism 21 and is available for a user. The sheet product dispenser 10 further comprises a second set of roll holders 36 to hold a second sheet product roll 56 (e.g., second product roll 156 of FIG. 2) near the bottom of the dispenser 10. A second web path 57 leads from the second sheet product roll 56 to a second dispensing mechanism 26 (e.g., second dispensing mechanism 126 of FIG. 2). Upon activation and after completing a dispense (using the second dispensing mechanism 26), a portion of the second sheet product roll 56 extends out of a second chute 48 below the second dispensing mechanism 26 and is available for a user.

Each dispensing mechanism 21, 26 may include components that enable dispensing of the portion of the corresponding sheet product roll. For example, the first dispensing mechanism 21 includes a first nip that is formed between a first pinch roller and first drive roller and covered by a first funnel cover. The first drive roller is driven by a motor (e.g., the first motor 122 of FIG. 2). The second dispensing mechanism 26 includes a second nip that is formed between a second pinch roller and second drive roller and covered by a second funnel cover. The second drive roller is driven by a motor (e.g., the second motor 127 of FIG. 2).

In some embodiments, the sheet product dispenser 10 may be an automatic dispenser. In such an embodiment, the sheet product dispenser 10 may include an activation sensor (e.g., activation sensor 120 of FIG. 2) that is configured to detect a user command, such as placement of the user's hand in a designated area or pulling on a leading edge of the paper towel roll. Upon sensing the user command, a controller (e.g., controller 110 of FIG. 2) in the dispenser may automatically cause the sheet product dispenser 10 to dispense sheet product from either one of the dispensing mechanisms using one or more motors to operate the corresponding drive roller (and, thus, the corresponding dispensing mechanism). The sensor may be a contact sensor, a non-contact sensor, or other suitable sensor. Alternatively, in some embodiments, the sheet product dispenser 10 may be configured as a non-automated dispenser. Some example sheet product dispensers are further described in U.S. application Ser. No. 15/479,656, entitled "Sheet Product Dispenser", which is assigned to the assignee of the present application, and which is incorporated by reference herein in its entirety.

Although the above described multi-roll dispenser includes two roll holders, some embodiments of the present invention are not meant to be limited to two roll holders, as any number of roll holders and corresponding product rolls may be utilized with the present invention. Additionally or alternatively, product rolls of various sizes are contemplated, including, for example, product rolls of different sizes in the same dispenser, such as a full product roll and a partially depleted product roll (e.g., stub roll). Along these lines, various embodiments described herein may be utilized with other various configurations including for example one dispensing mechanism (and, in some cases, a transfer mechanism—such as depending on how many rolls are utilized). Additionally, various embodiments may include manual dispensing mechanisms, such as a mechanical lever, a feed wheel, sheet pull, or the like.

Example Sheet Product Dispenser with Roll Partition

Figure 4:
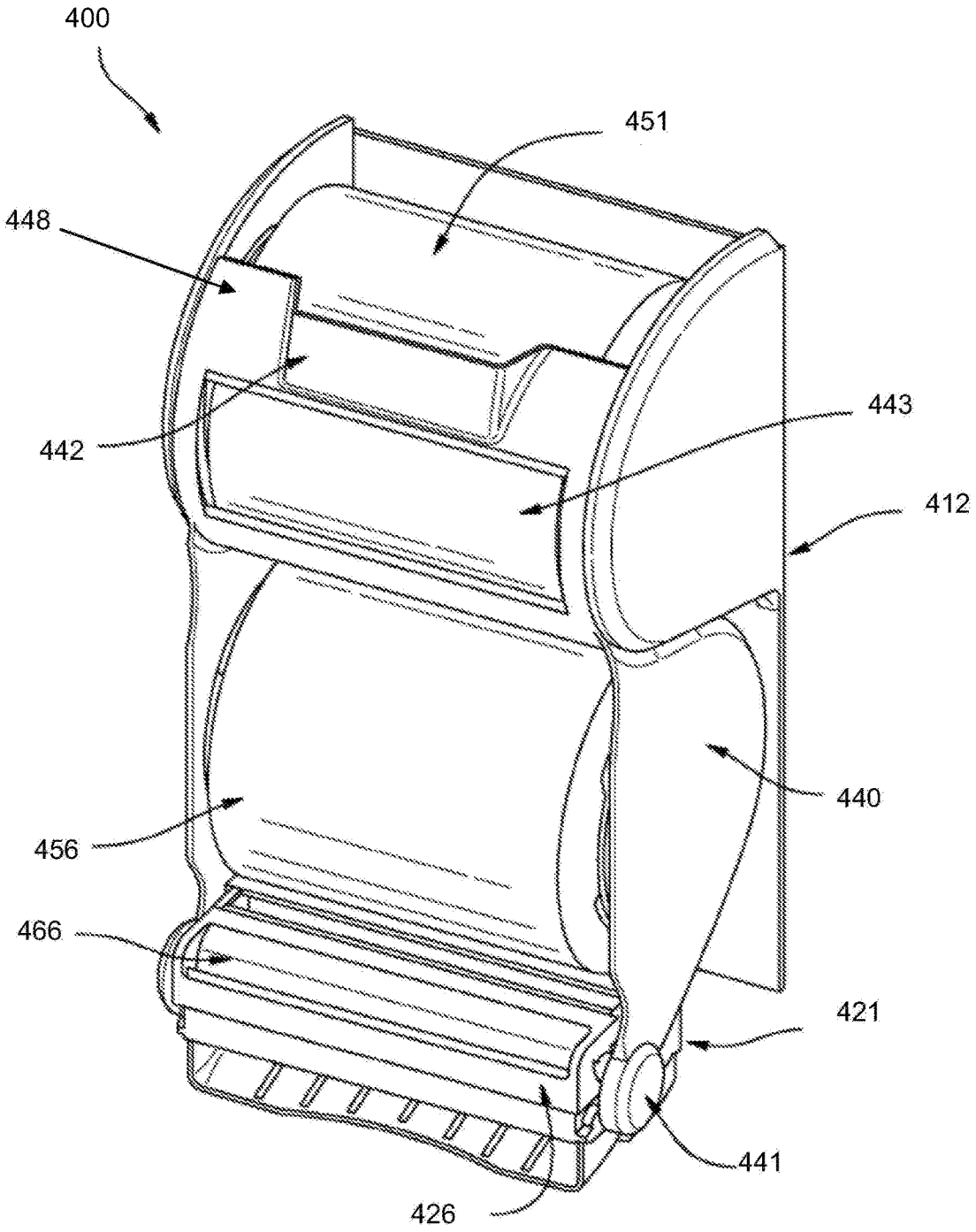
FIG. 4 illustrates a perspective view of a sheet product dispenser including a roll partition, in accordance with some example embodiments discussed herein.

In an example embodiment, the sheet product dispenser 10 may include a roll partition that includes a roll holder. In some embodiments, the roll partition may be movable separately from the cover 14. FIG. 4 illustrates an example embodiment related to providing a movable (e.g., rotatable, pivotable, displaceable, slidable, etc.) roll partition for example dispensers. Although the following example describes use of a roll partition, various example embodiments of the present invention may be utilized without a roll partition.

With reference to FIG. 4, the dispenser 400 is configured to hold a first product roll 451 and a second product roll 456. In order to separate the web paths and provide for easy loading, among others things, the dispenser 400 includes a roll partition 440 (e.g., an intermediate shell). In the depicted embodiment, the roll partition 440 is configured to hold the second product roll 456, such as through the second roll holders 436 which are attached to the roll partition 440. In some embodiments, the roll partition 440 may define a first portion 447 that is shaped (e.g., rounded) to cover at least a back portion of the second product roll 456 to separate the first web path of the first product roll 451 and the second product roll 456 and second web path when the roll partition is in the closed position. Additionally or alternatively, in some embodiments, the roll partition 440 may define a second portion 448 that is shaped and configured to at least partially cover the first product roll 451. The second portion 448 may be designed to cover the first product roll 451, but may also include one or more features (e.g., window 443) to aid in viewing the first product roll 451 such as for visual confirmation of the amount of product remaining on the first product roll 451. Further, the roll partition 440 may comprise a handle 442 that can be utilized to cause rotation of the roll partition 440 e.g., to or from the closed position shown.

Example Product Level Sensor

Figure 5:
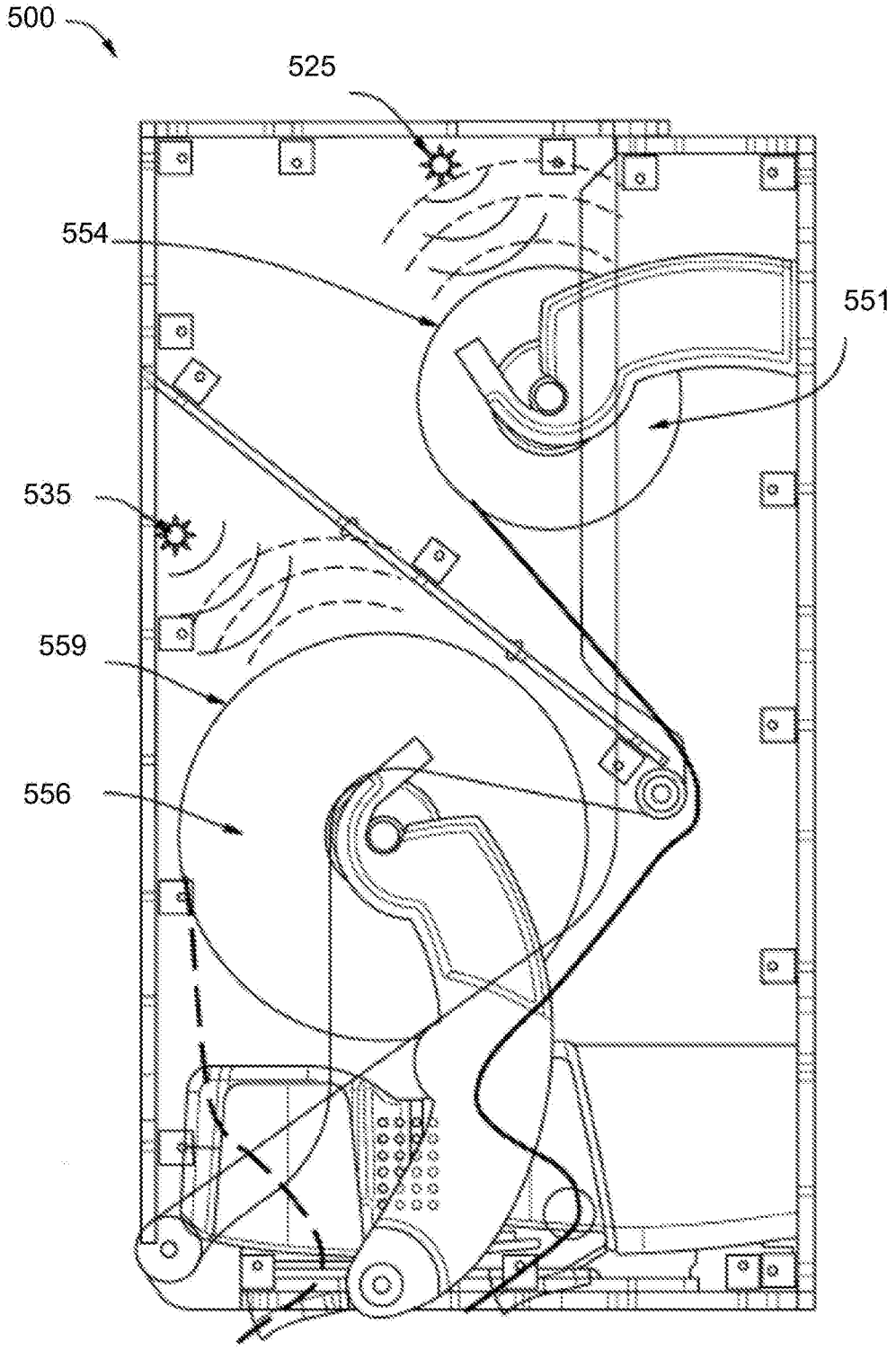
FIG. 5 illustrates an example product level system, in accordance with example embodiments described herein.

In some embodiments, the sheet product dispenser may include one or more product level sensors (e.g., product sensors 118 of FIG. 2) configured to determine the amount of product remaining on a product roll. In some embodiments, the product level sensors may be infrared (IR) sensors, ultrasonic sensors, or the like. FIG. 5 shows an example embodiment of a product dispenser 500 with a first product level sensor, e.g., first IR sensor 525, configured to determine the amount of product remaining for the first product roll 551 and a second product level sensor, e.g., second IR sensor 535, configured to determine the amount of product remaining for the second product roll 556. The first IR sensor 525 is configured to emit a signal, e.g., an infrared wavelength, which reflects off of an external surface 554 of the first product roll 551. The reflected infrared wavelength is then sensed by an IR receiver of the first IR sensor 525. Likewise, the second IR sensor 535 is configured to emit a signal, e.g., an infrared wavelength, which reflects off of an external surface 559 of the second product roll 556. The reflected infrared wavelength is then sensed by an IR receiver of the second IR sensor 535. Similarly, in some example embodiments utilizing an ultrasonic sensor, the ultrasonic sensor may emit an ultrasonic sound pulse and receive the reflected sound pulse from the product roll. In some example embodiments, the product level sensors 525, 535 may be operably coupled to the cover, the base portion, the roll partition, or any other suitable location within the sheet product dispenser 10.

Figure 8:
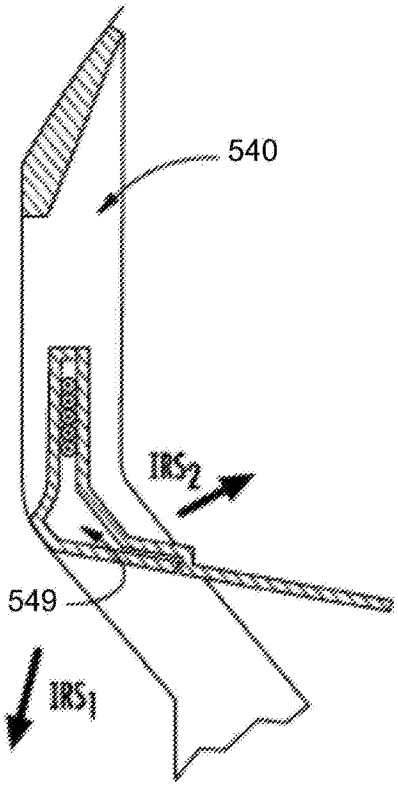
FIG. 8 illustrates a partial cross section view of the example roll partition of FIG. 7, in accordance with example embodiments described herein.
Figure 7:
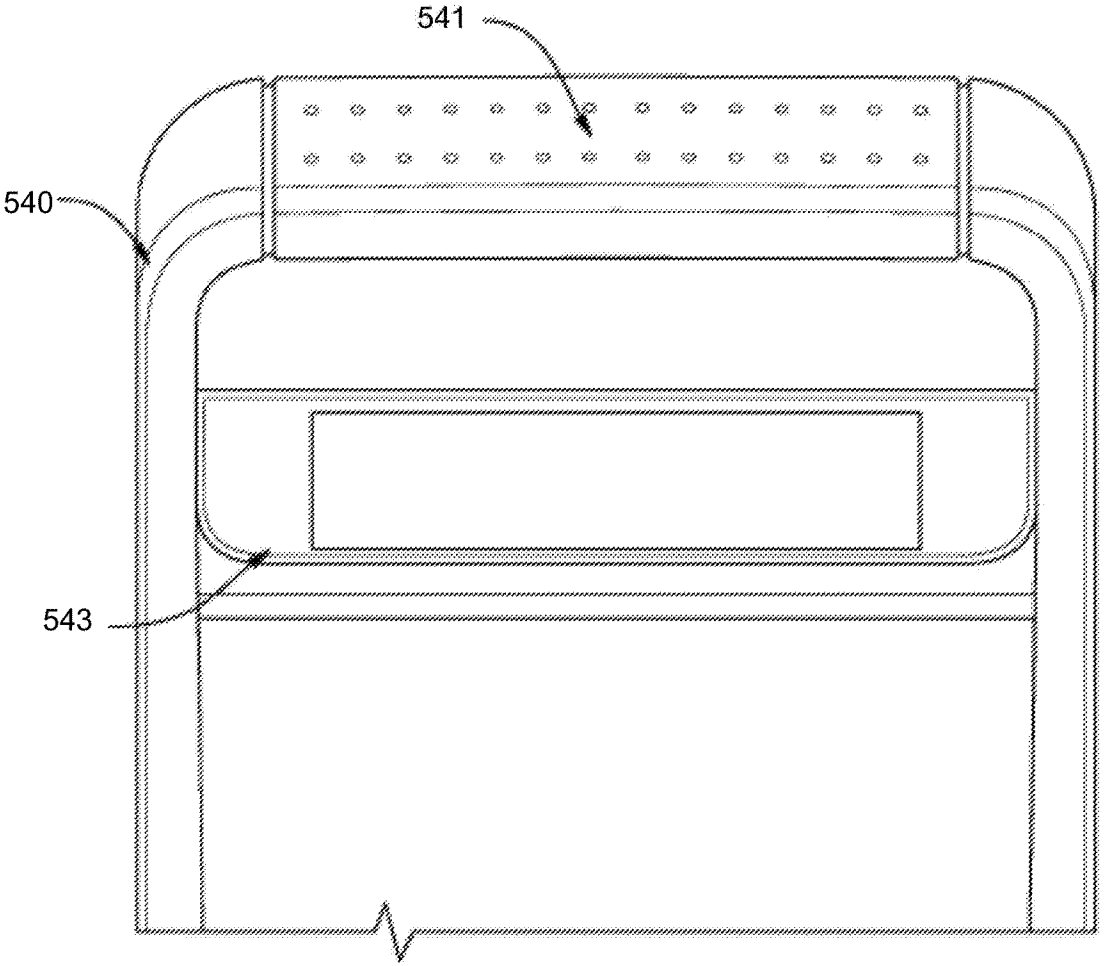
FIG. 7 illustrates a portion of an example roll partition, in accordance with example embodiments described herein.

In some embodiments with a web management feature (such as a roll partition), one or more product level sensors may be positioned on the web management feature and directed toward one or more of the product rolls. For example, with reference to FIG. 7, an example roll partition 540 may include a handle 541 (e.g., for a user to grasp and cause rotation of the roll partition). The roll partition 540 (or the handle thereof) may define a cross beam 543 that can be used for logo display and/or reinforcability. Additionally, in some embodiments, with reference to FIG. 8, one or more product level sensors may be housed within a portion of the roll partition 540, such as the cross beam 543. In the depicted embodiment, the one or more product level sensors may be positioned within an installation space 549. In some embodiments, a single product level sensor (e.g., an IR sensor) may be installed in the installation space 549 and include one or more emitters and one or more receivers that are oriented to detect product from a product roll (e.g., along either arrow $IRS_1$ or $IRS_2$). In some embodiments, a single product level sensor (e.g., an IR sensor system) may include multiple emitters and/or receivers that may be oriented to detect product from both product rolls—such as being oriented toward each arrow $IRS_1$ and $IRS_2$). In some embodiments, two separate product level sensors may be utilized to detect product from both product rolls (each product level sensor being oriented toward a corresponding product roll).

In some example embodiments, the product level sensor may emit a signal, e.g., a light beam or sound pulse, and measure the amount of time that it takes for the light or sound to reflect off of the first sheet product roll 551 or second sheet product roll 556 and return to a detector (e.g., the product level sensor measures the time-of-flight of the signal). The "time-of-flight" of a signal may, in some embodiments, be defined as the time interval from transmission of a signal from an emitter of the product level sensor to receipt of the return of the signal at a receiver of the product level sensor. The time-of-flight of the signal is directly correlated to the distance to the product roll, since the speed of light, or speed of sound, is known and constant. In this manner, the controller 110 (and/or one or more remote processor) is able to determine the distance to the product roll surface, which can be used to determine, for example, the diameter of (and, thus, the amount of product remaining for) the first sheet product roll 551 or second sheet product roll 556.

Example Product Depletion Curve

Figure 6:
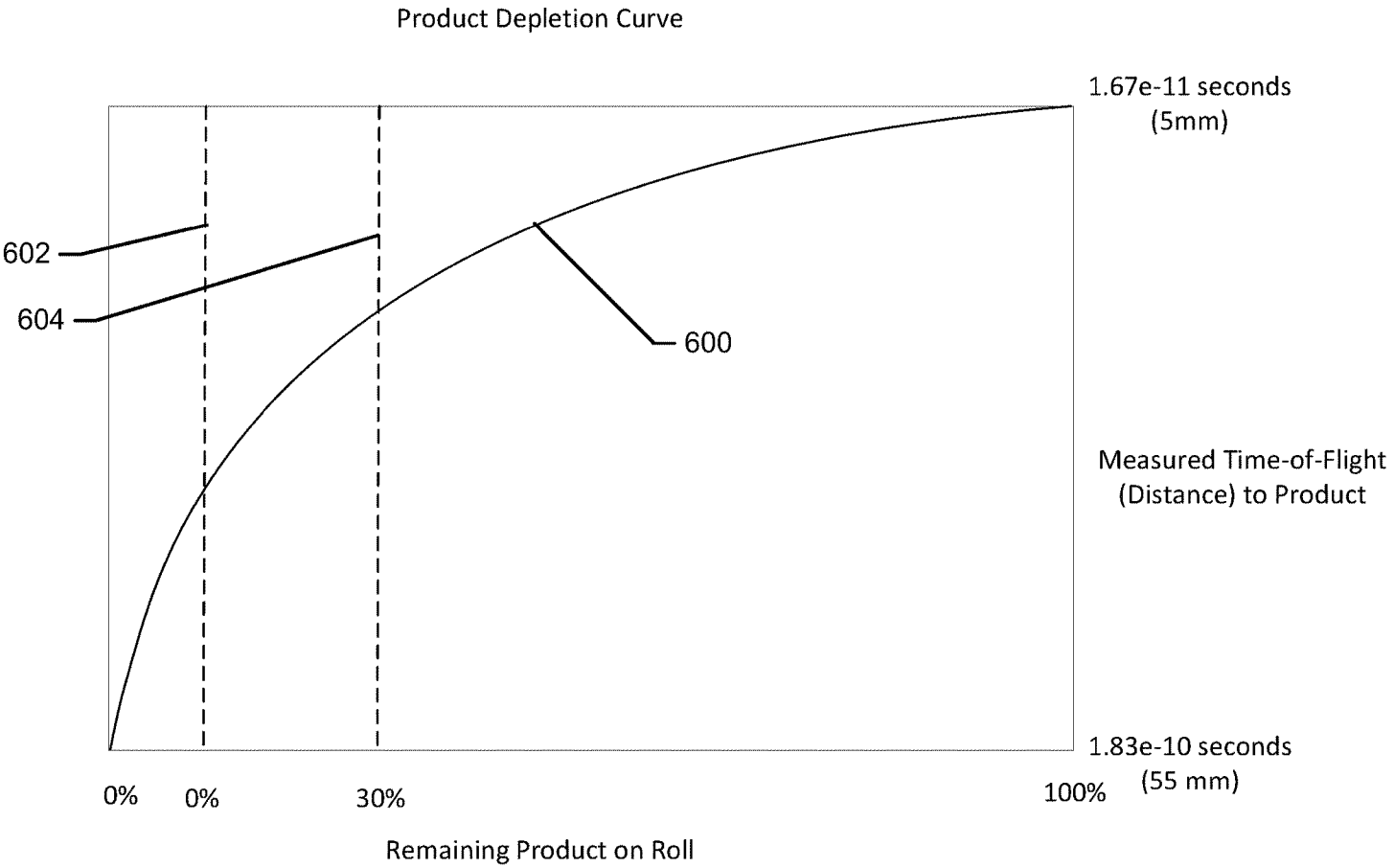
FIG. 6 illustrates an example product depletion curve, in accordance with example embodiments described herein.

In some example embodiments, the controller 110 may determine the remaining product level by comparing the measured time-of-flight of the signal (or a "measured" distance that is determined based on the measured time-of-flight) to a product depletion curve, such as the product depletion curve 600 shown in FIG. 6. In this regard, since the time-of-flight is directly correlated to distance, the determination of the amount of product remaining may be made, for example, by either a correlation of the measured time-of-flight to the amount of product remaining or a correlation of a measured distance (that is determined from the measured time-of-flight) to the amount of product remaining. As such, in the depicted embodiment, the y axis of the product depletion curve 600 includes both example time-of-flight values and corresponding distance values. As used in some embodiments herein, the "measured" distance may refer to a distance that is determined using a measured time-of-flight. In this regard, "measured" may relate to a current measurement (such as the time-of-flight measurement).

The product depletion curve 600 may be generated based on a standard or average product roll for the dispenser. The outermost surface of the product roll facing the product level sensor may be a first distance from the product level sensor when the product roll is full (e.g., 100 percent), such as 5 mm. The outermost surface of the product roll facing the product level sensor may be a second distance from the product level sensor when the product roll is depleted (e.g., 0 percent), such as 55 mm. The product depletion curve 600 may have a generally parabolic curve due to the decreasing diameter of the product roll as the sheet product is dispensed from the product roll.

Example Product Level Determination and Indication

In some example embodiments, the controller 110 may be configured to determine the amount of product remaining, such as during normal operation. For example, the controller 110 may receive an indication of a time-of-flight of a signal from the product level sensor and utilize the product depletion curve to determine an amount of product remaining. Such a correlation, as noted above, could be based directly on the measured time-of-flight or through a conversion to a measured distance (which was determined based on the measured time-of-flight). In some embodiments, the determination of the measured distance and/or the amount of product remaining may occur on one or more remote processors. In some such embodiments, the determined information could, for example, be communicated back to the controller 110 for further processing or operation, such as providing one or more product level indications to a user.

In some example embodiments, the controller 110 may be configured to determine the remaining product level in response to a triggering event. A triggering event may include a dispense of sheet product, a predetermined number of dispenses, such as 5 dispenses, 10 dispenses, or the like, a predetermined interval, or other suitable event, such as closing the cover (which may indicate loading of a new product roll).

In some example embodiments, the controller 110 may compare the remaining product level to one or more predetermined product thresholds. In some example embodiments, the controller 110 may compare the remaining product level to a first product threshold 604 associated with a low product level, such as 30 percent, 25 percent, 20 percent, or the like. In some example embodiments, the controller 110 may compare the remaining product level to a second product threshold 602 associated with a depleted product roll, such as 10 percent, 5 percent, 0 percent, or the like.

The controller 110 may be configured to cause one or more dispenser indicators to provide an indication to a user in response to satisfying, e.g., the remaining product level being less than, one or more of the product thresholds 602, 604. The controller 110 may cause an indicator, such as one or more light emitting diodes (LEDs), digital display, or the like, to indicate a first color or blink pattern in response to no product thresholds being satisfied, for example green or a first blink rate. The controller 110 may cause the indicator to indicate a second color or blink pattern in response to the low product level threshold 602 being satisfied, such as yellow, a fast blink rate, two pulses or the like. The controller 110 may cause the indicator to indicate a third color or blink pattern in response to satisfying the depleted product threshold 604, such as red, a faster blink rate, four pulses, constant illumination, or the like. In an example embodiment including two product rolls, the indicator may be off if neither roll satisfies a product level threshold; may blink at a first blink rate, such as one blink per 3 second interval, if one roll satisfies a product level threshold; and/or may blink at a second blink rate, such as 150 msec on/150 msec off, if both rolls satisfy the product level threshold.

Though the above described embodiments detail use of one or more LEDs as indicators, some embodiments of the present invention contemplate other indicators, such as one or more speakers, one or more displays, one or more liquid crystal displays, one or more seven segment displays, one or more electrophoretic displays, among others. In some embodiments, an example display may show an indication of the remaining product level using a percentage (e.g., 25% remaining).

Additionally or alternatively, the controller 110 may be configured to cause an alert in response to satisfying one or more of the product level thresholds 602, 604. The alert may be an audio or visual indication of the product level or the product level threshold that has been satisfied. In some embodiments, the controller 110 may cause the alert at the sheet product dispenser.

In some example embodiments, the controller 110 may send (e.g., periodically) product level information to a remote computing device, such as based on time intervals (e.g., every 5 seconds, 10 minutes, etc.) and/or threshold change intervals (e.g., every 10 percent product level threshold, 5 percent product level threshold, etc.). In some embodiments, the controller 110 may transmit data, including, for example, the measured time-of-flight and/or distance, to the remote computing device for performing various functions described herein, such as determining the measured distance, determining the remaining product level, performing a calibration of the product depletion curve (such as described further herein), determining various indications/alerts to provide to a user, and/or other various instructions or processes.

The remote computing device may include, without limitation, a maintenance service computing device, computer workstation, maintenance kiosk, mobile computing device, smart phone, laptop, tablet computer, or the like. In some example embodiments, the controller 110 may be configured to transmit the product level information and/or other data wirelessly. For example, the controller 110 may utilize a short range communication protocol (e.g., Bluetooth, Bluetooth low energy, or the like). A gateway device may receive the short range communication and transmit the data to the remote computing device utilizing long range communication protocols such as WiFi, cellular, or the like. The gateway device may be a dedicate device, such as a WiFi access point or washroom monitor, a washroom fixture, such as another product dispenser, faucet, toilet, or the like, or a roving device, such as a smart device, e.g. phone watch, personal data assistance, or the like associated with a service person. Additionally or alternatively, the controller 110 may utilize long range communication protocols such as WiFi, cellular, or the like to transmit the data to the remote computing device.

Product Depletion Curve Calibration

In some embodiments, the controller 110 may be configured to calibrate the product depletion curve, such as by adjusting the product depletion curve 600 to compensate for variance in the product roll and/or the construction of the specific sheet product dispenser 10. In some example embodiments, the controller 110 is configured to calibrate the product depletion curve 600 based on at least one full product roll and/or at least one depleted product roll installed into the sheet product dispenser 10. As discussed herein, a depleted product roll refers to a product roll having no remaining sheet product or effectively no remaining sheet product and a partially depleted product roll refers to a product roll having less than full sheet product, but more than no remaining sheet product.

In some embodiments, the controller 110 may be configured to adjust the product depletion curve 600 based on a full product roll (e.g., 100% remaining) or a depleted product roll (e.g., 0% remaining). In this regard, the 100% remaining and 0% remaining points on the product depletion curve may be used to adjust the product depletion curve (e.g., up or down) to account for any inconsistencies between the actual specific dispenser and the predetermined manufacturing specifications. For example, as described in greater detail herein, if the measured time-of-flight for a new full product roll for a specific dispenser is greater than what the predetermined (e.g., at manufacturing) product depletion curve would expect, than the time-of-flight value that correlates to the 100% remaining point for the product depletion curve for that specific dispenser may be adjusted (such as to the measured time-of-flight value)—effectively, in some embodiments, shifting the entire product depletion curve.

In some embodiments, the controller 110 may be configured to initiate a calibration routine in response to a triggering event. For example, to initiate calibration based on a full (100% remaining) product roll, the controller 110 may receive an indication that a product roll has been installed on a product roll holder. The indication may be a manual actuation of a roll reset switch by a maintainer, an automatic determination, such as a large, e.g., greater than 50 percent, greater than 70 percent, or the like, increase in remaining product level, or other suitable method, such as closing the cover.

Similarly, in some embodiments, the controller 100 may be configured to initiate calibration based on a depleted (0% remaining) product roll by receiving an indication that a product roll is depleted. In some example embodiments, the indication that the product roll is depleted may be manual activation of the roll reset switch, an automatic determination based on a time-of-flight measurement, an automatic determination based on a sensor, such as the funnel sensor 141 or the chute sensor 142 detecting no sheet product being dispensed, or other suitable method, such as opening or closing the cover. In an example embodiment, the indication of the product roll being depleted may include a combination of an indication from the funnel sensor 141 that no sheet product is being dispensed and a time-of-flight measurement indicating that the product roll is at or near the 0 percent value, such as 50 to 60 mm. In some embodiments, the controller 110 may be further configured to determine that no product roll is present and perform no calibration, for example, the time-of-flight measurement may indicate a measured distance which is indicative of no product roll being present, such as 160 mm (which could be indicative of the signal reflecting off a back wall of the dispenser 10—since no product roll is present in between).

During the calibration routine, the controller 110 may be configured to determine a time-of-flight of the signal emitted to and reflected back from the surface of the sheet product on the product roll. For example, in the case of calibration for a full product roll, such a measurement may occur after replacement of the product roll. In the case of calibration for a depleted product roll, in some embodiments, the controller 110 may "look back" in memory, using the last time-of-flight measurement prior to the product roll replacement (e.g., the last time-of-flight reading stored in memory of the controller or product level sensor). In some embodiments, the controller 110 may be configured to calibrate the full product roll point or depleted product roll point of the product depletion curve directly based on the time-of-flight measurement or convert the time-of-flight measurement to a measured distance, as described herein.

In some embodiments, the controller 100 may determine the expected time-of-flight or expected distance using the current (not yet adjusted) product depletion curve. Additionally, the controller 110 may be configured to compare the expected time-of-flight and/or distance to the measured time-of-flight and/or distance to determine if there is a difference.

In some embodiments, the controller 110 may be configured to adjust the product depletion curve. For example, the controller 110 may adjust the product depletion curve (such as update the 0 percent value or 100 percent value) based on the comparison between the measured time-of-flight and/or distance and the expected time-of-flight and/or distance.

In some embodiments, the controller 110 may include a predetermined curve shape for the product depletion curve 600, which may cause all of the values of the product depletion curve 600 to shift due to the adjustment of the 0 percent or 100 percent values. In some example embodiments, the controller 110 may include multiple product depletion curves 600 for various product roll types. In some such embodiments, the controller 110 may compare the measured time-of-flight and/or distance value to each of the product completion curves and select the product depletion curve 600 which includes a full product roll expected value closest to the measured value.

In some example embodiments, the controller 110 may be configured to determine an average measured time-of-flight and/or distance based on a predetermined number of measurements, such as 2 measurements, 5 measurements, 10 measurements, or the like. The controller 110 may determine the difference between the average measured time-of-flight and/or distance and the expected time-of-flight and/or distance, and adjust the product depletion curve 600 based on the average measured time-of-flight and/or distance in response to and/or based on a difference between the average measured time-of-flight and/or distance and the expected time-of-flight and/or distance.

In some example embodiments, the controller 110 may be configured to determine if the difference between the measured time-of-flight and/or distance or the average measured time-of-flight and/or distance and the expected time-of-flight and/or distance (as determined from the corresponding point on the predetermined product depletion curve) satisfies a predetermined adjustment threshold, such as 0.5 mm, 1 mm, or the like. The controller 110 may then be configured to adjust the product depletion curve 600 if the difference is greater than the adjustment threshold or, alternatively, continue operation of the sheet product dispenser 10 without adjustment in response to the difference failing to satisfy the predetermined adjustment threshold. The predetermined adjustment threshold may prevent inaccurate calibration or calibration hunting for insignificant differences between the measured distance and the expected distance.

Though the above described embodiments are focused on calibration at the 100% remaining or 0% remaining points on the product depletion curve, various embodiments of the present invention contemplate performing calibration at other points. In some such examples, threshold ranges for the measured time-of-flight and/or distance may be used to determine the point of calibration (e.g., 30% remaining) for the adjustment of the product depletion curve. For example, if a measured time-of-flight and/or distance is within a range of measurements that correspond to 30% product remaining, that measurement could be used to update the 30% product remaining point on the product depletion curve.

Example Limitations for Adjustments During the Calibration Routine

In some example embodiments, the controller 110 may limit the adjustment of the product depletion curve 600 (e.g., to prevent course adjustment, which may be in error), such as by limiting the adjustment to an incremental adjustment. For example, if the controller 110 determines a difference of 3 mm between the measured distance and the expected distance, the controller 110 may limit the adjustment to a predetermined adjustment increment of 1 mm. If taken again and the controller 110 determines a difference of 2 mm between the measured distance and the new adjusted expected distance, the controller 110 may still limit the adjustment to the predetermined adjustment increment of 1 mm. Such example embodiments may be useful for preventing false/inconsistent readings or overcompensation if, for example, one product roll is unexpectedly bigger than the other product rolls.

In some example embodiments, the controller 110 may be configured to determine if the difference between the measured time-of-flight and/or distance and the expected time-of-flight and/or distance exceeds a maximum adjustment threshold, such as 0.5 mm, 1 mm, 2 mm, or the like. In response to the difference between the measured time-of-flight and/or distance and the expected time-of-flight and/or distance exceeding the predetermined maximum adjustment threshold, the controller 110 may limit or clip the adjustment to the predetermined maximum adjustment threshold (e.g., a predetermined adjustment increment). For example, if the controller 110 determines a difference of 1.8 mm between the measured distance and the expected distance, the controller 110 may limit the adjustment to a predetermined maximum adjustment threshold of 1 mm.

In some example embodiments, the controller 110 may be configured to limit a total adjustment of the full product value or the depleted product value from the programmed 0 percent value and 100 percent value. The controller 110 may include a total or aggregate adjustment limit for all adjustments made to each value of the product depletion curve 600, which prevents the full product value or depleted product value of the product depletion curve 600 from being adjusted beyond a predetermined value. Adjustments beyond the predetermined value may be due to a calibration error, selection of an incorrect product depletion curve 600, or the like. In some example embodiments, the controller 110 may be configured to determine if the difference between the measured time-of-flight and/or distance and the expected time-of-flight and/or distance exceeds a predetermined total adjustment threshold, such as 3, mm, 5 mm, 8 mm, 10 mm, or the like. In response to the difference between the measured time-of-flight and/or distance and the expected time-of-flight and/or distance exceeding the predetermined total adjustment threshold, the controller 110 may limit or prevent an adjustment. For example, if the controller 110 determined that the difference was 1.8 mm with an accumulated adjustment of 4.1 mm and a predetermined total adjustment threshold of 5 mm, the controller 110 may limit the adjustment to 0.9 mm. In another example, if the accumulated adjustment equals the predetermined total adjustment threshold, the controller may prevent further adjustment in that direction.

In some example embodiments, the controller 110 may be configured to limit the adjustment direction of the product depletion curve value 600. For example, the product depletion curve 600 may be initially set with a full product value larger than an anticipated full product roll, and the adjustments may only occur in one direction, e.g., reducing the full product roll value of the product depletion curve. For example, the expected distance associated with the full product value may be initially set high, such as may correspond to between 22-25 mm, and may be reduced to a calibrated value of approximately 19 mm. Similarly, the product depletion curve 600 may be initially set with a depleted product value smaller than an anticipated depleted product roll, and the adjustments may only occur in one direction, e.g., increasing the depleted product roll value of the product depletion curve. For example, the expected distance associated with the depleted product value may initially be set low, such as may correspond to 100 mm and be raised to approximately 120 mm. Limiting the adjustments in one direction may enable a controlled removal engineering and manufacturing variance. The initial settings of the depleted product value and full product value may be restored by cycling power to the dispenser 10, such as removing the power supply (e.g., the batteries) to the controller 110, cycling one or more maintenance switches, or the like.

Example System Architecture

A schematic representation of components of an example product dispenser system 100 according to various embodiments described herein is shown in FIG. 2. It should be appreciated that the illustration in FIG. 2 is for purposes of description and that the relative size and placement of the respective components may differ. The product dispenser system 100, which includes a product dispenser 105 (e.g., a sheet product dispenser), includes components and systems that are utilized in various embodiments described herein.

The product dispenser 105 may include many different components and/or systems (such as shown in FIG. 2), including, for example, a controller 110, a roll partition 140, a first dispensing mechanism 121, a second dispensing mechanism 126, a first funnel sensor 141, a second funnel sensor 146, a first chute sensor 142, a second chute sensor 147, a first tear bar mechanism 124, a second tear bar mechanism 129, a memory 112, a communication interface 113, one or more user interfaces 114, a power system 116, an activation sensor 120, one or more product sensors (e.g., product level sensors) 118, and other system(s)/sensor(s) 115. Though shown in FIG. 2 as being a component of the product dispenser 105, such components are not required to be part of the product dispenser 105 according to various embodiments herein. For example, product dispensers of various embodiments described herein may include different components, but still function according to the desired embodiment. For example, some embodiments only include one product roll (as opposed to the two shown in FIG. 2) and, thus, the components may only include one dispensing mechanism, one chute sensor, one funnel sensor, and one tear bar mechanism Similarly, some embodiments may employ a transfer mechanism to enable transfer between product rolls for dispensing from a single dispensing mechanism. Along these lines, the depicted embodiment of FIG. 2 is provided for explanatory purposes and is not meant to be limiting.

The controller 110 provides logic and control functionality used during operation of the product dispenser 105.

Alternatively, the functionality of the controller 110 may be distributed to several controllers that each provides more limited functionality to discrete portions of the operation of product dispenser 105.

The product dispenser 105 may be configured to hold two full product rolls. For example, the depicted product dispenser 105 houses a first product roll 151, such as may be received by a first set of roll holders that are attached to a base of the product dispenser 105. Additionally, the product dispenser 105 houses a second product roll 156, such as may be received by a second set of roll holders. In the depicted embodiment, the second product roll 156 is received within roll holders that are attached to a roll partition 140.

The roll partition 140 may be designed, in some embodiments, to hold a product roll (e.g., product roll 156). Additionally, the roll partition 140 may be movably (e.g., pivotably) attached to the base and/or cover of the product dispenser 105, thereby enabling movement of the roll partition between a closed position and an open position. In some embodiments, the roll partition 140 may be configured to help separate or manage the web paths of the first product roll 151 and the second product roll 156.

The activation sensor 120 may be configured to sense/receive user input (such as a user's hand or portion thereof) indicating a desire to cause the product dispenser 105 to dispense a portion of product (e.g., a portion of sheet from the first or second product roll). The activation sensor 120 may be any type of sensor or feature capable of receiving user input to begin dispensing, including for example, a capacitive sensor, a light sensor, an IR sensor, a mechanical lever or button, etc. The activation sensor 120 may be in communication with the controller 110 such that the controller 110 can determine when to cause dispensing of the product.

The first and second dispensing mechanism 121, 126 may each be configured to cause dispensing of a portion of the product, such as a portion (or length) of the roll of product (e.g., the first or second product roll). Depending on the configuration, the dispensing mechanisms 121, 126 may each comprise a motor (e.g., first motor 122 or second motor 127, respectively) that drives one or more drive rollers (e.g., first roller(s) 123 or second roller(s) 128, respectively). In each dispensing mechanism, a portion of the product roll may be sandwiched (e.g., in frictional contact) between the drive roller and one or more pinch rollers such that operation/rotation of the drive roller causes dispensing of a portion of the product roll. The first and second dispensing mechanism motors 122, 127 may be in communication with the controller 110 such that the controller 110 may control operation of the motors 122, 127.

The example sheet product dispenser may, in some cases, include one or more funnels that help direct or lead sheet product into a corresponding nip of a dispensing mechanism. The example sheet product dispenser 105 may include first and second funnel sensors 141, 146 that may each be positioned within or relative to the funnels for the corresponding first and second dispensing mechanisms 121, 126 and configured to sense the presence (or absence) of product within the corresponding funnels. For example, the first funnel sensor 141 may be positioned to sense for product within the funnel leading into the first dispensing mechanism 121. In some embodiments, the first and second funnel sensors 141, 146 may be configured to utilize infrared sensing capabilities to sense the presence of the product in the funnel. In some embodiments, however, other types of sensors may be utilized (e.g., capacitive sensors, light sensors, mechanical sensors, etc.). The first and second funnel sensors 141, 146 may be in communication with the controller 110 such that the controller 110 may determine when product is present or absent within each funnel.

The first and second chute sensors 142, 147 may each be positioned within or relative to the chutes for the corresponding first and second dispensing mechanisms 121, 126 and configured to sense the presence (or absence) of product within the corresponding chutes. For example, the first chute sensor 142 may be positioned to sense for product within the chute extending from the first dispensing mechanism 121 (e.g., where the product is dispensed). In some embodiments, the first and second chute sensors 142, 147 may be configured to utilize IR sensing capabilities to sense the presence of the product in the chute(s). In some embodiments, however, other types of sensors may be utilized (e.g., capacitive sensors, light sensors, mechanical sensors, etc.). The first and second chute sensors 142, 147 may be in communication with the controller 110 such that the controller 110 may determine when product is present or absent within each chute.

The first and second tear mechanisms 124, 129 may each be configured to enable tearing of the dispensed portion of the product roll. In this regard, the first and second tear mechanisms 124, 129 may each comprise a tear bar or other feature that can enable a user to provide a force to tear off the portion of the product roll. For example, the first and second tear mechanisms 124, 129 may include a serrated edge that cuts into the sheet when the user pulls the dispensed product. The separated portion of the product from the product roll may then be used and discarded as necessary by the user. Alternatively, the first and second tear mechanisms 124, 129 may be configured to perform a tear or partial tear prior to interaction with the user such that the user simply pulls on the pre-torn portion of the product roll to complete dispensing of the portion of the product. In some embodiments, the first and second tear mechanisms 124, 129 may be configured to detect the occurrence of tearing of the product. For example, the first and second tear mechanisms 124, 129 (or portions thereof) may be configured to enable sensing of the occurrence of tearing, such as by moving in response to tearing occurring. In such embodiments, the movement of the tear mechanism can be sensed, thereby indicating occurrence of tearing. In some embodiments, other types of tear mechanisms that can sense tearing of the product can be utilized. In this regard, the first and second tear mechanisms 124, 129 may be in communication with the controller 110 such that the controller 110 may determine when product is torn (such as during a dispense).

The product sensor(s) 118 (e.g., product level sensor(s)) is configured to sense product data (e.g., from the first and/or second product roll). In some embodiments, the product data may correspond to dispensing from at least one of the first product roll or the second product roll (e.g., how much product is being dispensed, when product is being dispensed, which product roll is dispensing occurring from, etc.). Additionally or alternatively, the product data may correspond to an amount of product remaining for at least one of the first product roll or the second product roll (e.g., a remaining size of the product roll, an amount of the product roll remaining, etc.). The product sensor 118 may be in communication with the controller 110 such that the controller 110 may receive the product data and perform one or more determinations regarding the product data (e.g., if one or more of the product rolls are substantially depleted, which product roll is dispensing, if there is leftover product in an exit chute, if there is a product jam, among others). Depending on the configuration of the product dispenser 105 and/or the desired information/product data, one or more product sensors 118 may be configured to sense data from the first product roll 151, the second product roll 156, and/or other components of the product dispenser 105 (e.g., the first and second tear mechanisms 124, 129, the first and second dispensing mechanisms 121, 126, etc.). Similarly, multiple product sensors 118 may be configured to sense different types of data from the same product roll, such as one sensor to measure the roll size (e.g. diameter) and another sensor for sensing active dispensing.

In an example embodiment in which a transfer mechanism is provided, the transfer mechanism may be configured to cause transfer of the leading edge of a product roll into the dispensing mechanism 121 to enable dispensing from that product roll. The transfer mechanism may be any feature or component capable of performing the transfer, such as one or more tucker fingers, transfer rollers, or the like. In this regard, upon substantial depletion of one of the product rolls, the transfer mechanism may be activated to move the leading edge of the remaining product roll into the dispensing mechanism 121 (e.g., the nip between the drive roller and pinch roller) to transfer dispensing to that remaining product roll. This avoids an empty scenario and allows continuous dispensing of product to occur between product rolls. Though the transfer mechanism is shown as interacting with the first product roll 151, in some embodiments the transfer mechanism may interact with the second product roll 156 (such as when the first product roll 151 is being dispensed from).

The controller 110 is a suitable electronic device capable of executing dispenser functionality via hardware and/or software control, with the preferred embodiment accepting data and instructions, executing the instructions to process the data, and presenting the results. Controller 110 may accept instructions through the user interface 114, or through other means such as but not limited to the activation sensor 120, other sensors, voice activation means, manually-operable selection and control means, radiated wavelength and electronic or electrical transfer. Therefore, the controller 110 can be, but is not limited to, a microprocessor, microcomputer, a minicomputer, an optical computer, a board computer, a complex instruction set computer, an ASIC (application specific integrated circuit), a reduced instruction set computer, an analog computer, a digital computer, a molecular computer, a quantum computer, a cellular computer, a solid-state computer, a single-board computer, a buffered computer, a computer network, a desktop computer, a laptop computer, a personal digital assistant (PDA) or a hybrid of any of the foregoing.

The controller 110 may be operably coupled with one or more components of the product dispenser 105. Such operable coupling may include, but is not limited to, solid-core wiring, twisted pair wiring, coaxial cable, fiber optic cable, mechanical, wireless, radio, and infrared. Controller 110 may be configured to provide one or more operating signals to these components and to receive data from these components. Such communication can occur using a well-known computer communications protocol such as Inter-Integrated Circuit (I2C), Serial Peripheral Interface (SPI), System Management Bus (SMBus), Transmission Control Protocol/Internet Protocol (TCP/IP), RS-232, ModBus, or any other communications protocol suitable for the purposes disclosed herein.

The controller 110 may include one or more processors coupled to a memory device 112. Controller 110 may optionally be connected to one or more input/output (I/O) controllers or data interface devices (not shown). The memory 112 may be any form of memory such as an EPROM (Erasable Programmable Read Only Memory) chip, a flash memory chip, a disk drive, or the like. As such, the memory 112 may store various data, protocols, instructions, computer program code, operational parameters, etc. In this regard, controller 110 may include operation control methods embodied in application code. These methods are embodied in computer instructions written to be executed by one or more processors, typically in the form of software. The software can be encoded in any language, including, but not limited to, machine language, assembly language, VHDL (Verilog Hardware Description Language), VHSIC HDL (Very High Speed IC Hardware Description Language), Fortran (formula translation), C, C++, Visual C++, Java, ALGOL (algorithmic language), BASIC (beginners all-purpose symbolic instruction code), visual BASIC, ActiveX, HTML (HyperText Markup Language), and any combination or derivative of at least one of the foregoing. Additionally, an operator can use an existing software application such as a spreadsheet or database and correlate various cells with the variables enumerated in the algorithms. Furthermore, the software can be independent of other software or dependent upon other software, such as in the form of integrated software.

In this regard, in some embodiments, the controller 110 may be configured to execute computer program code instructions to perform aspects of various embodiments of the present invention described herein. For example, the controller 110 may be configured to determine an instance in which one of the product rolls is substantially depleted. In such a regard, in some embodiments, the controller 110 may be configured to switch between operation of the first and second dispensing mechanisms 121, 126 to ensure constant ability to dispense product—such as described in various example embodiments herein.

The user interface 114 may be configured to provide information and/or indications to a user. In some embodiments, the user interface 114 may comprise one or more light emitting diodes (LEDs) to indicate such information (e.g., low battery, dispensing is occurring, low product level, transfer complete, etc.). In some embodiments, the user interface 114 may include a screen to display such information. In some embodiments, the user interface 114 may include an interface on the exterior of the product dispenser 105 such as for an end consumer. Additionally or alternatively, the user interface 114 (including a second user interface) may be configured to provide information or indications to a maintainer (e.g., maintenance personnel), such as internally of the cover of the product dispenser 105.

In some embodiments, the user interface 114 may be configured to receive user input such as through a keypad, touchscreen, buttons, or other input device. The user interface 114 may be in communication with the controller 110 such that the controller 110 can operate the user interface 114 and/or receive instructions or information from the user interface 114. In some embodiments, the user interface 114 may include an interface on the exterior of the product dispenser 105 such as for an end consumer. Additionally or alternatively, the user interface 114 (including a second user interface) may be internal of the cover of the product dispenser 105, such as for a maintainer (e.g., maintenance personnel).

The communication interface 113 may be configured to enable connection to external systems (e.g., an external network 102). In this manner, the controller 110 may retrieve data and/or instructions from or transmit data and/or instructions to a remote, external server via the external network 102 in addition to or as an alternative to the memory 112.

In an example embodiment, the electrical energy (e.g., power 116) for operating the product dispenser 105 may be provided by a battery, which may be comprised of one or more batteries arranged in series or in parallel to provide the desired energy. For example, the battery may comprise four 1.5-volt "D" cell batteries. Additionally or alternatively, the power 116 may be supplied by an external power source, such as an alternating current ("AC") power source or a solar power source, or any other alternative power source as may be appropriate for an application. The AC power source may be any conventional power source, such as a 120V, 60 Hz wall outlets for example.

The other sensor(s)/system(s) 115 may be any other type of sensors or systems that are usable in various embodiments of the present invention. Some example additional sensors or systems include a position sensor, a time sensor, a cover opening or closing sensor, among many others.

As indicated herein, some embodiments of the present invention may be utilized with other types of product dispensers (such as mechanical product dispensers). Additional information regarding non-automated (mechanical) product dispensers, including components and functionality thereof, can be found in U.S. Pat. No. 7,270,292 and U.S. Pat. No. 5,441,189, both of which are assigned to the owner of the present invention and incorporated by reference in their entireties.

Example Flowchart(s)

Embodiments of the present invention provide methods, apparatuses and computer program products for controlling and operating product dispensers according to various embodiments described herein. Various examples of the operations performed in accordance with embodiments of the present invention will now be provided with reference to FIGS. 9-12.

FIGS. 9-12 illustrate flowcharts according to example methods for controlling operation of a product dispenser to determine and/or indicate a product level according to an example embodiment. The operations illustrated in and described with respect to FIGS. 9-12 may, for example, be performed by, with the assistance of, and/or under the control of one or more of the controller 110, memory 112, communication interface 113, user interface 114, product sensor 118, first or second dispensing mechanism 121/126, first or second funnel sensor 141/146, first or second chute sensor 142/147, first or second tear mechanism 124/129, activation sensor 120, and/or other sensor(s)/system(s) 115 of the product dispenser 105.

Figure 9:
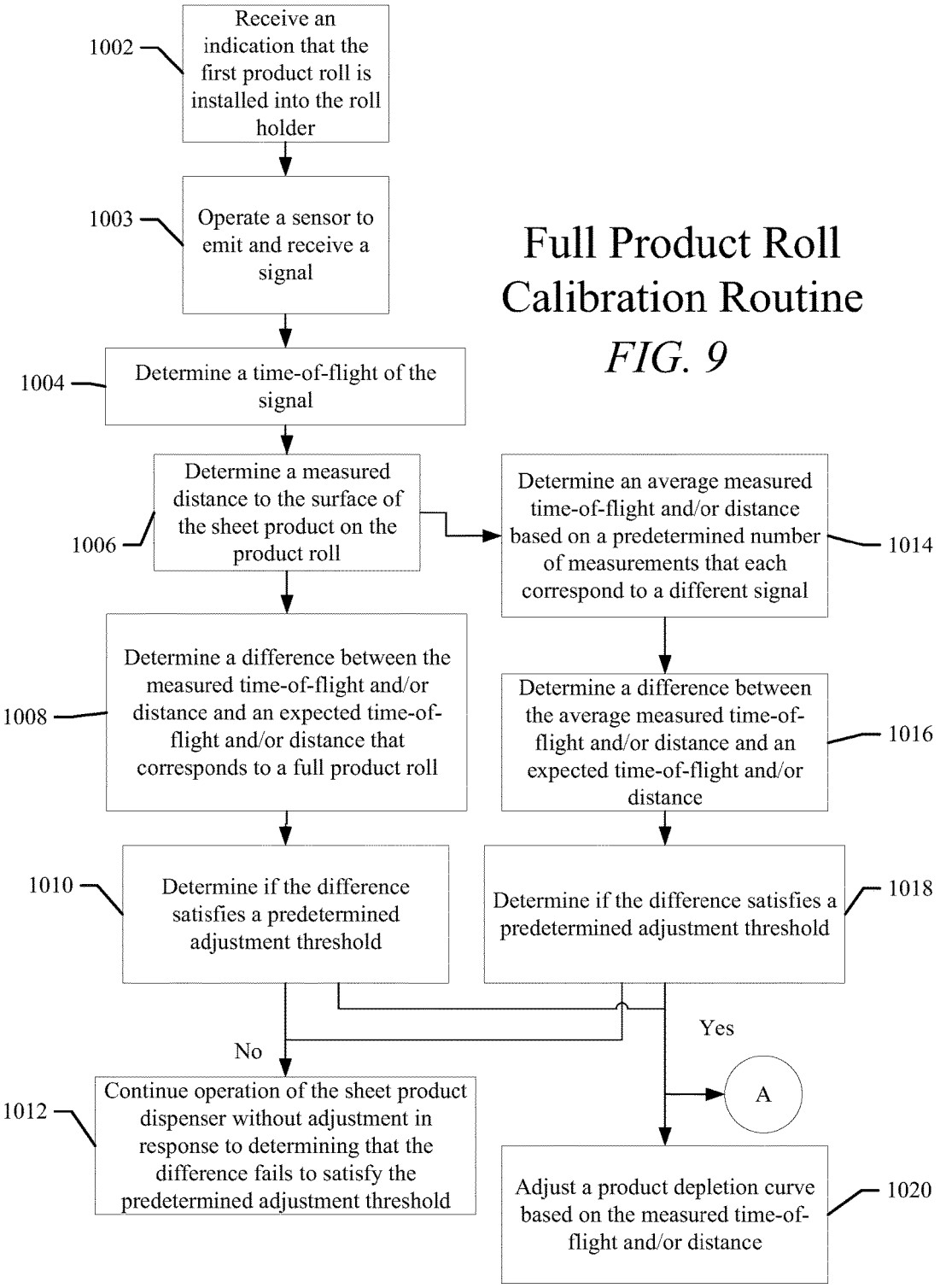
FIG. 9 illustrates a flowchart of an example calibration routine for calibrating a product depletion curve for a full product roll, in accordance with some embodiments discussed herein.

FIG. 9 illustrates an example method for a calibration routine based on a full product roll according to various example embodiments described herein. The method may include receiving an indication that the first product roll is installed into the roll holder at operation 1002. For example, as described herein, the controller 110 may determine that a new product roll has been placed in the roll holder. At operation 1003, the product level sensor may emit and receive a signal. At operation 1004, the time-of-flight of the signal may be measured. Such a time-of-flight of the signal, for example, is the time period from when the signal was emitted by the sensor to when the signal was received by the sensor. For example, in some embodiments, the time-of-flight is a measurement of the amount of time between a time t(0) when the signal is emitted by the product level sensor and a time t(1) when the return signal is received by the product level sensor. At operation 1006, a measured distance to the surface of the sheet product on the product roll may be determined based on the measured time-of-flight.

The method may also include determining a difference between the measured time-of-flight and/or distance and an expected time-of-flight and/or distance that corresponds to a full product roll at operation 1008, determining if the difference between the measured time-of-flight and/or distance and the expected time-of-flight and/or distance satisfies a predetermined adjustment threshold at operation 1010, and continuing operation of the sheet product dispenser without adjustment, in response to the difference failing to satisfy the predetermined adjustment threshold at operation 1012.

In some embodiments the method may include determining an average measured time-of-flight and/or distance based on a predetermined number of measurements that each correspond to a different signal at operation 1014, determining a difference between the average measured time-of-flight and/or distance and an expected time-of-flight and/or distance at operation 1016, and/or determine if the difference between the average measured time-of-flight and/or distance and the expected time-of-flight and/or distance satisfies a predetermined adjustment threshold at operation 1018.

The method may conclude by adjusting a product depletion curve based on the measured time-of-flight and/or distance at operation 1020.

Figure 10:
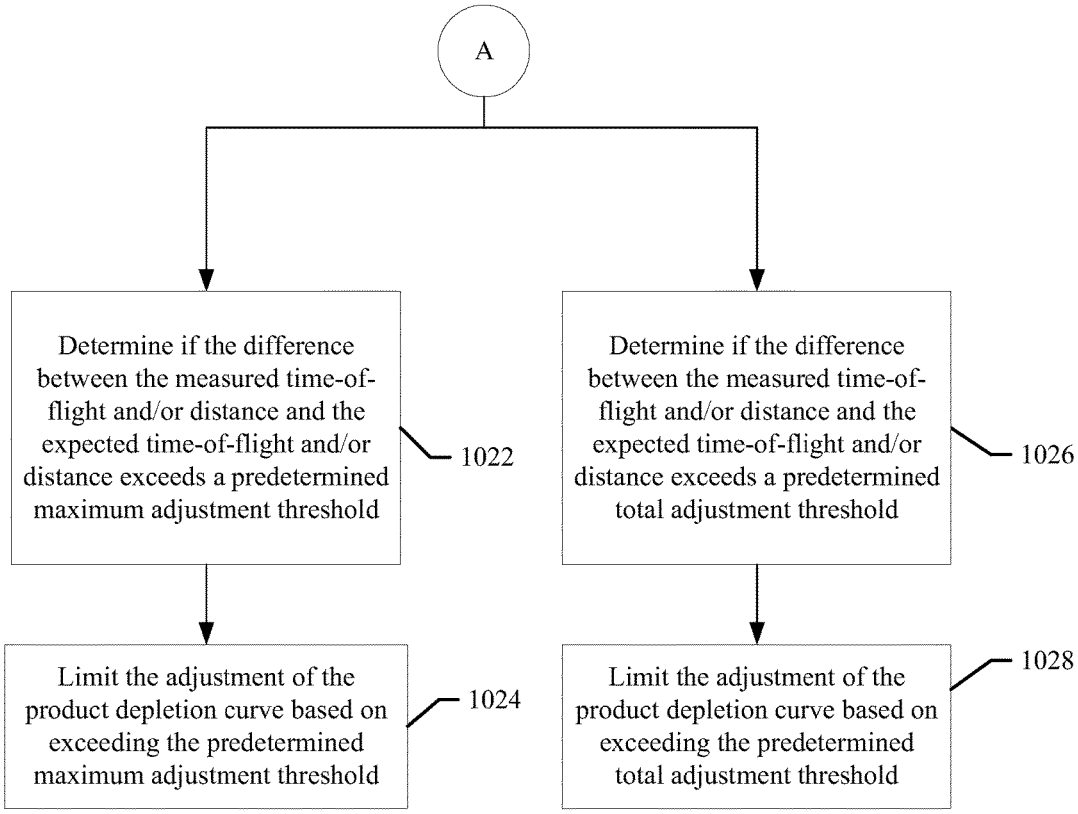
FIG. 10 illustrates a flowchart of an example calibration adjustment limitation routine for limiting adjustment of a product depletion curve, in accordance with some embodiments discussed herein.

With reference to FIG. 10, in some example embodiments the calibration of FIG. 9 (and FIG. 11 as described later) may include adjustment limitations. The method of FIG. 9 may continue at "A" including, for example, determining if the difference between the measured time-of-flight and/or distance and the expected time-of-flight and/or distance exceeds a predetermined maximum adjustment threshold at operation 1022 and limiting the adjustment of the product depletion curve based on exceeding the predetermined maximum adjustment threshold at operation 1024. In another example embodiment, the method may include determining if the difference between the measured time-of-flight and/or distance and the expected time-of-flight and/or distance exceeds a predetermined total adjustment threshold at operation 1026 and limiting the adjustment of the product depletion curve based on exceeding the predetermined total adjustment threshold at operation 1028.

Figure 11:
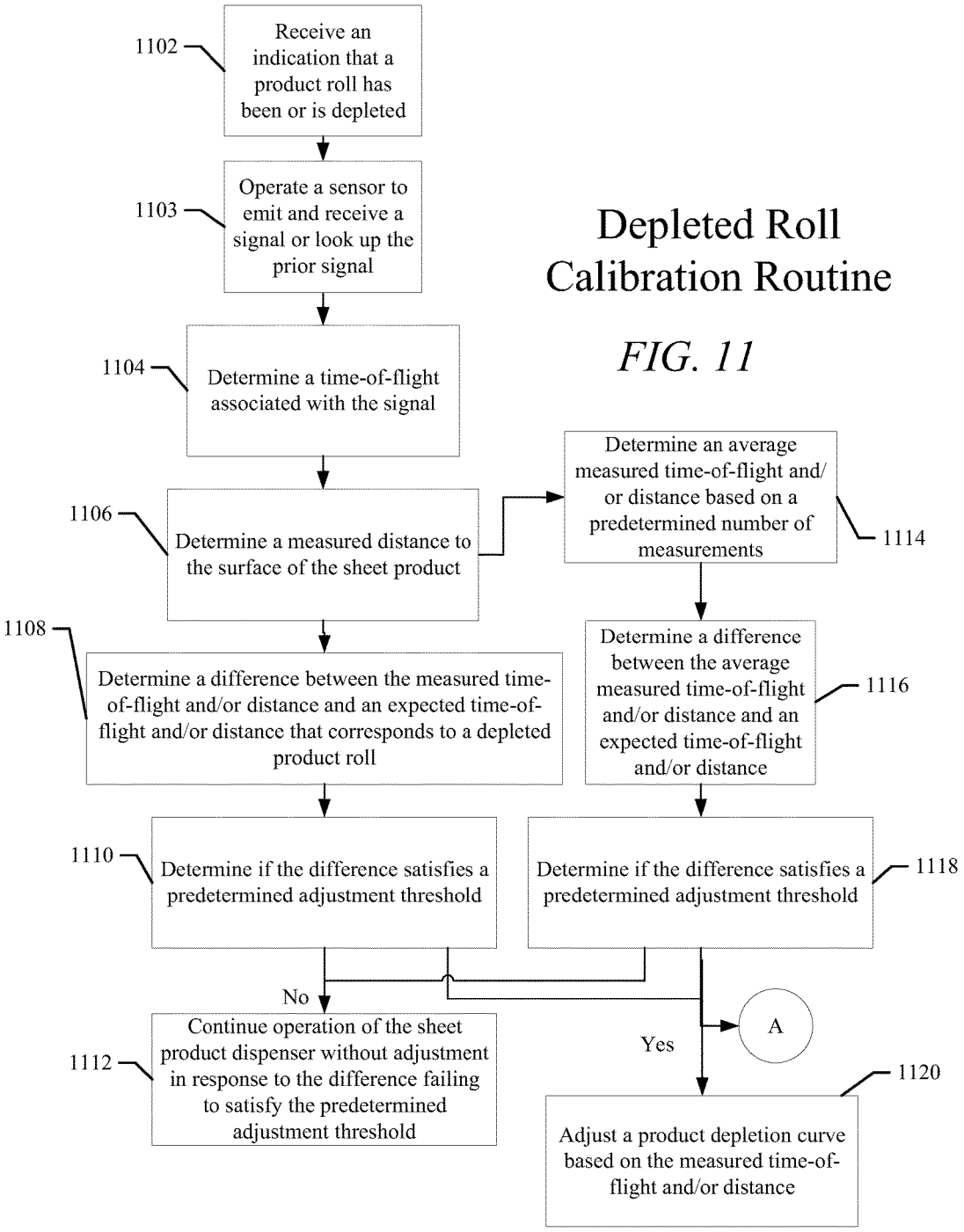
FIG. 11 illustrates a flowchart of an example calibration routine for calibrating a product depletion curve for a depleted product roll, in accordance with some embodiments discussed herein.

FIG. 11 illustrates an example method for a calibration routine based on a depleted product roll according to various example embodiments. The method may include receiving an indication of a product roll depletion at operation 1102. For example, as described herein, the controller 110 may determine that a new product roll has been placed in the roll holder, such that the previous product roll was depleted. At operation 1103, the product level sensor may be operated to emit and receive the signal for the depleted product roll (when one is determined) or a prior sensor signal may be looked up if determination occurs upon insertion of a new product roll. At operation 1104, a time-of-flight associated with the signal is determined. At operation 1106, a measured distance to the surface of the sheet product roll may be determined, such as by using the measured time-of-flight. The method may also include determining a difference between the measured time-of-flight and/or distance and an expected time-of-flight and/or distance that corresponds to a depleted product roll at operation 1108. Finally, the method may include adjusting the product depletion curve accordingly at operation 1120.

In some embodiments, the method may include determining if the difference between the measured time-of-flight and/or distance and the expected time-of-flight and/or distance satisfies a predetermined adjustment threshold at operation 1110, and continuing operation of the sheet product dispenser without an adjustment, in response to the difference failing to satisfy the predetermined adjustment threshold at operation 1112.

In some embodiments, the method may include determining an average measured time-of-flight and/or distance based on a predetermined number of measurements at operation 1114, determining a difference between the average measured time-of-flight and/or distance and an expected time-of-flight and/or distance at operation 1116, determining if the difference between the average measured time-of-flight and/or distance and the expected time-of-flight and/or distance satisfies a predetermined adjustment threshold at operation 1118, and/or adjusting a product depletion curve based on the difference between the measured time-of-flight and/or distance and the expected time-of-flight and/or distance at operation 1120. Similar to FIG. 9, the adjustment limitations of FIG. 10 may also be applicable to the calibration routine based on the depleted product roll.

Figure 12:
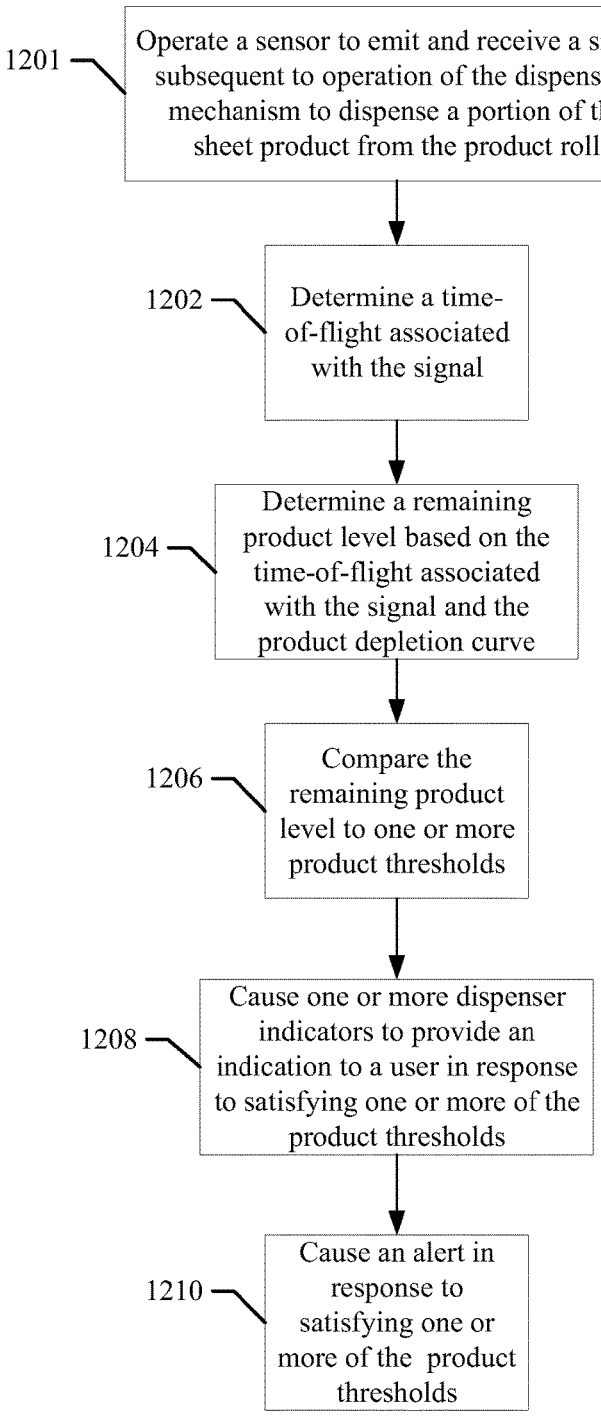
FIG. 12 illustrates a flowchart of an example routine for providing one or more indications and/or alerts of an amount of product remaining to a user, in accordance with some embodiments discussed herein.

FIG. 12 illustrates an example normal operating routine for the product dispenser. The method may include operating a sensor to emit and receive a signal, such as subsequent to operation of the dispensing mechanism to dispense a portion of the sheet product from the product roll at operation 1201, determining a time-of-flight associated with the signal at operation 1202, and determining a remaining product level based on the time-of-flight associated with the signal and the product depletion curve at operation 1204. The method may also include comparing the remaining product level to one or more product thresholds at operation 1206. In some example embodiments, the method may include causing one or more dispenser indicators to provide an indication to a user, such as in response to satisfying one or more of the product thresholds at operation 1208 and/or causing an alert, such as in response to satisfying one or more of the product thresholds at operation 1210.

FIGS. 9-12 illustrate flowcharts of a system, method, and computer program product according to various example embodiments described herein. It will be understood that each block of the flowcharts, and combinations of blocks in the flowcharts, may be implemented by various means, such as hardware and/or a computer program product comprising one or more computer-readable mediums having computer readable program instructions stored thereon. For example, one or more of the procedures described herein may be embodied by computer program instructions of a computer program product. In this regard, the computer program product(s) which embody the procedures described herein may be stored by, for example, the memory 112 and executed by, for example, the controller 110. As will be appreciated, any such computer program product may be loaded onto a computer or other programmable apparatus to produce a machine, such that the computer program product including the instructions which execute on the computer or other programmable apparatus creates means for implementing the functions specified in the flowchart block(s). Further, the computer program product may comprise one or more non-transitory computer-readable mediums on which the computer program instructions may be stored such that the one or more computer-readable memories can direct a computer or other programmable device (for example, product dispenser 105) to cause a series of operations to be performed on the computer or other programmable apparatus to produce a computer-implemented process such that the instructions which execute on the computer or other programmable apparatus implement the functions specified in the flowchart block(s).

Associated systems and methods for manufacturing example product dispensers described herein are also contemplated by some embodiments of the present invention.

Conclusion

Many modifications and other embodiments of the inventions set forth herein may come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

The invention claimed is:

1. A sheet product dispenser comprising:

a housing including a base portion and a cover, wherein the cover is movable relative to the base portion to define an open position and a closed position;

at least one roll holder configured to receive a product roll;

a dispensing mechanism configured to receive sheet product from the product roll and dispense a portion of the sheet product from the product roll;

a sensor configured to emit a signal toward the product roll and receive the signal, wherein the signal is reflected off a surface of the product roll; and a controller configured to:

receive an indication that the product roll was installed into the at least one roll holder;

operate the sensor to emit and receive the signal;

determine a time-of-flight of the signal that correlates to a time period from when the signal was emitted by the sensor to when the signal was received by the sensor;

determine an expected characteristic of a theoretical signal for a theoretical full product roll installed in the sheet product dispenser, wherein the expected characteristic comprises at least one of an expected time-of-flight of the theoretical signal and an expected distance to the surface of the theoretical full product roll;

compare a characteristic of the signal to the expected characteristic of the theoretical signal, wherein the characteristic of the signal is at least one of the time-of-flight of the signal or a distance to the surface of the installed product roll, wherein the distance is determined based on the time-of-flight of the signal; and adjust a product depletion curve based on the comparison.

2. The sheet product dispenser of claim 1, wherein the controller is further configured to:

operate the sensor to emit and receive a second signal subsequent to operation of the dispensing mechanism to dispense the portion of the sheet product from the product roll;

determine a time-of-flight associated with the second signal; and determine a remaining product level based on the time-of-flight associated with the second signal and the adjusted product depletion curve.

3. The sheet product dispenser of claim 2, wherein the controller is further configured to:

compare the remaining product level to one or more predetermined product thresholds; and cause one or more dispenser indicators to provide an indication to a user in response to satisfying one or more of the predetermined product thresholds.

4. The sheet product dispenser of claim 2, wherein the controller is further configured to:

compare the remaining product level to one or more predetermined product thresholds; and cause an alert in response to satisfying one or more of the predetermined product thresholds.

5. The sheet product dispenser of claim 1, wherein the controller is further configured to:

determine if a difference between the characteristic of the signal and the expected characteristic of the theoretical signal satisfies a predetermined adjustment threshold; and adjust, in response to determining that the difference satisfies the predetermined adjustment threshold, the product depletion curve by a predetermined incremental adjustment value, wherein the predetermined incremental adjustment value is the same regardless of a degree of the difference between the characteristic of the signal and the expected characteristic of the theoretical signal.

6. The sheet product dispenser of claim 1, wherein the controller is further configured to:

determine if a difference between the characteristic of the signal and the expected characteristic of the theoretical signal satisfies a predetermined adjustment threshold; and continue, in response to determining that the difference fails to satisfy the predetermined adjustment threshold, operation of the sheet product dispenser without an adjustment to the product depletion curve.

7. The sheet product dispenser of claim 1, wherein the controller is further configured to:

determine an average characteristic of the signal based on a predetermined number of measurements that each correspond to a different signal; and determine a difference between the average characteristic of the signal and the expected characteristic of the theoretical signal, wherein the adjustment of the product depletion curve is based on the difference between the average characteristic of the signal and the expected characteristic of the theoretical signal.

8. The sheet product dispenser of claim 1, wherein the controller is further configured to:

determine if the difference between the characteristic of the signal and the expected characteristic of the theoretical signal exceeds a maximum adjustment threshold; and limit the adjustment to the product depletion curve to the predetermined maximum adjustment threshold in response to the difference between the characteristic of the signal and the expected characteristic of the theoretical signal exceeding the predetermined maximum adjustment threshold.

9. The sheet product dispenser of claim 1, wherein the controller is further configured to:

receive an indication that the product roll is depleted;

operate the sensor to emit and receive a second signal;

determine a time-of-flight associated with the second signal;

determine an expected characteristic of a theoretical second signal for a theoretical depleted product roll in the sheet product dispenser, wherein the expected characteristic comprises at least one of an expected time-of-flight of the theoretical second signal and an expected distance to the surface of the theoretical depleted product roll;

compare a characteristic of the second signal to the expected characteristic of the theoretical second signal, wherein the characteristic of the second signal is at least one of the time-of-flight of the second signal or a distance to the surface of the depleted product roll, wherein the distance is determined based on the time-of-flight of the second signal; and adjust the product depletion curve based on the comparison of the characteristic of the second signal to the expected characteristic of the theoretical second signal.

10. The sheet product dispenser of claim 1 further comprising:

a second roll holder configured to receive a second product roll; and a second sensor configured to emit a second signal toward the second product roll and receive the second signal, wherein the second signal is reflected off a surface of the second product roll.

11. The sheet product dispenser of claim 10, wherein the product roll is a first product roll, wherein the sheet product dispenser further comprises a roll partition disposed between the first product roll and the second product roll, wherein the sensor is a first sensor, and wherein at least one of the first sensor and the second sensor is attached to the roll partition.

12. The sheet product dispenser of claim 1, wherein the sensor is attached to the base portion.

13. The sheet product dispenser of claim 1, wherein the sensor is attached to the cover.

14. The sheet product dispenser of claim 1, wherein determining the time-of-flight of the signal enables determining an amount of product remaining on the product roll independent of a color of the sheet product of the product roll.

15. The sheet product dispenser of claim 1, wherein the controller is further configured to limit adjustment of the product depletion curve to one direction for each adjustable value.

16. A method of calibrating a product depletion curve for a sheet product dispenser, the method comprising:

receiving an indication that a product roll was installed in the sheet product dispenser, wherein the sheet product dispenser comprises a dispensing mechanism configured to receive sheet product from the product roll and dispense a portion of the sheet product from the product roll;

operating a sensor to emit and receive a signal, wherein the sensor is configured to emit the signal toward the product roll and receive the signal, wherein the signal is reflected off a surface of the product roll;

determining a time-of-flight of the signal that correlates to a time period from when the signal was emitted by the sensor to when the signal was received by the sensor;

determining an expected characteristic of a theoretical signal for a theoretical full product roll installed in the sheet product dispenser, wherein the expected characteristic comprises at least one of an expected time-of-flight of the theoretical signal and an expected distance to the surface of the theoretical full product roll;

comparing a characteristic of the signal to the expected characteristic of the theoretical signal, wherein the characteristic of the signal is at least one of the time-of-flight of the signal or a distance to the surface of the installed product roll, wherein the distance is determined based on the time-of-flight of the signal; and adjusting the product depletion curve based on the comparison.

17. The method of claim 16 further comprising:

operating the sensor to emit and receive a second signal subsequent to operation of the dispensing mechanism to dispense the portion of the sheet product from the product roll;

determining a time-of-flight associated with the second signal; and determining a remaining product level based on the time-of-flight associated with the second signal and the adjusted product depletion curve.

18. A sheet product dispenser comprising:

a housing configured to receive a product roll for dispensing from the sheet product dispenser, wherein the product roll comprises a roll of sheet product and defines a cylindrical shape with a diameter and an outer surface;

a sensor positioned within the housing and configured to emit a signal toward the outer surface of the product roll and receive a reflection of the signal after the signal bounces off the outer surface of the product roll, wherein the product roll is positioned within the housing such that, as sheet product is dispensed from the product roll, the diameter of the product roll decreases and the outer surface moves further away from the sensor; and a controller configured to:

operate the sensor to emit the signal and receive the reflection of the signal;

determine a time-of-flight of the signal that correlates to a time period from when the signal was emitted by the sensor to when the reflection of the signal was received by the sensor;

compare at least one of the determined time-of-flight of the signal or a distance to the outer surface of the product roll determined using the determined time-of-flight to a corresponding predetermined time-of-flight or predetermined distance, wherein the predetermined time-of-flight is associated with an expected predetermined time-of-flight for a theoretical product roll installed in the housing, wherein the predetermined distance is associated with an expected distance from the sensor to a theoretical product roll installed in the housing; and adjust a product depletion curve based on the comparison.

19. The sheet product dispenser of claim 18, wherein the controller is further configured to:

operate the sensor to emit a second signal subsequent to dispensing of the sheet product from the product roll;

determine a time-of-flight associated with the second signal; and determine a remaining product level based on the time-of-flight associated with the second signal and the adjusted product depletion curve.

20. The sheet product dispenser of claim 18, wherein the controller is further configured to:

determine if a difference between the at least one of the determined time-of-flight of the signal or the distance to the outer surface of the product roll and the corresponding predetermined time-of-flight or predetermined distance satisfies a predetermined adjustment threshold; and adjust, in response to determining that the difference satisfies the predetermined adjustment threshold, the product depletion curve by a predetermined incremental adjustment value, wherein the predetermined incremental adjustment value is the same regardless of a degree of the difference.

* * * * *